US010543679B2

(12) United States Patent
Masuda et al.

(10) Patent No.: US 10,543,679 B2
(45) Date of Patent: Jan. 28, 2020

(54) INK JET PRINTING APPARATUS

(71) Applicant: CANON KABUSHIKI KAISHA, Tokyo (JP)

(72) Inventors: Satoshi Masuda, Yokohama (JP); Toru Yamane, Yokohama (JP); Kyosuke Deguchi, Yokohama (JP); Ryosuke Hirokawa, Kawasaki (JP); Toru Ohnishi, Yokohama (JP); Akihiro Mouri, Fuchu (JP); Noboru Toyama, Kawasaki (JP); Atsushi Sakamoto, Yokohama (JP); Yoshiyuki Honda, Yokohama (JP); Taku Higashiyama, Yokohama (JP); Susumu Hirosawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/042,200

(22) Filed: Jul. 23, 2018

(65) Prior Publication Data

US 2018/0326719 A1 Nov. 15, 2018

Related U.S. Application Data

(63) Continuation of application No. PCT/JP2017/002666, filed on Jan. 26, 2017.

(30) Foreign Application Priority Data

Jan. 29, 2016 (JP) ..... 2016-016269
Jan. 29, 2016 (JP) ..... 2016-016659
(Continued)

(51) Int. Cl.
*B41J 2/01* (2006.01)
*B41J 11/00* (2006.01)
*B41M 7/00* (2006.01)

(52) U.S. Cl.
CPC ..... *B41J 2/01* (2013.01); *B41J 11/0015* (2013.01); *B41M 7/00* (2013.01)

(58) Field of Classification Search
CPC ..... B41J 2/01; B41J 11/0015; B41J 2/0458; B41J 2/04566; B41J 2/04563;
(Continued)

(56) References Cited

U.S. PATENT DOCUMENTS 3,962,153 A 6/1976 Gore
5,841,456 A 11/1998 Takei et al.
(Continued)

FOREIGN PATENT DOCUMENTS

CN 1990241 A 7/2007
CN 101332708 A 12/2008
(Continued)

OTHER PUBLICATIONS

International Preliminary Report on Patentability dated Jul. 31, 2018, in International Application No. PCT/JP2017/002666.
(Continued)

*Primary Examiner* — Stephen D Meier
*Assistant Examiner* — Alexander D Shenderov
(74) *Attorney, Agent, or Firm* — Venable LLP

(57) ABSTRACT

A liquid holding amount of a porous body of a liquid absorbing member for removing at least a portion of an aqueous liquid component from an image obtained by ink jet printing is controlled so as to reduce damage to the porous body while maintaining performance of removing attached matters from the porous body by using a cleaning member which abuts on the porous body and has an adhesive force.

15 Claims, 12 Drawing Sheets

(30) Foreign Application Priority Data

Feb. 15, 2016 (JP) ..... 2016-026419
May 30, 2016 (JP) ..... 2016-107448
May 30, 2016 (JP) ..... 2016-107960
May 30, 2016 (JP) ..... 2016-107962

(58) Field of Classification Search
CPC .. B41J 2/04581; B41J 2002/012; B41M 7/00; B41M 5/03; B41M 5/0256
USPC ..... 347/103
See application file for complete search history.

(56) References Cited

U.S. PATENT DOCUMENTS

| | | | |
|---|---|---|---|
| 6,916,081 | B2 | 7/2005 | Nakashima |
| 7,129,284 | B2 | 10/2006 | Ma et al. |
| 7,419,257 | B2 | 9/2008 | Mouri et al. |
| 7,422,318 | B2 | 9/2008 | Kadomatsu et al. |
| 7,481,526 | B2 | 1/2009 | Inoue |
| 7,494,213 | B2 | 2/2009 | Taniuchi et al. |
| 7,497,564 | B2 | 3/2009 | Yui |
| 7,556,342 | B2 | 7/2009 | Hamano |
| 7,594,722 | B2 | 9/2009 | Kadomatsu et al. |
| 7,766,457 | B2 | 8/2010 | Chen |
| 7,845,760 | B2 | 12/2010 | Hirakawa |
| 7,926,933 | B2 | 4/2011 | Taniuchi et al. |
| 7,997,717 | B2 | 8/2011 | Taniuchi et al. |
| 8,226,225 | B2 | 7/2012 | Yamanobe |
| 8,246,158 | B2 | 8/2012 | Ageishi et al. |
| 8,857,962 | B2 | 10/2014 | Goto et al. |
| 9,067,449 | B2 | 6/2015 | Morita et al. |
| 9,102,137 | B2 | 8/2015 | Koitabashi et al. |
| 9,616,653 | B2 | 4/2017 | Liu |
| 9,769,171 | B2 | 9/2017 | Gomi |
| 9,821,584 | B2 | 11/2017 | Noguchi et al. |
| 10,046,556 | B2 | 8/2018 | Soma et al. |
| 10,137,690 | B2 | 11/2018 | Hirokawa et al. |
| 2006/0055755 | A1 | 3/2006 | Yui |
| 2006/0061642 | A1 | 3/2006 | Ueki |
| 2006/0170752 | A1 | 8/2006 | Kadomatsu et al. |
| 2006/0221166 | A1* | 10/2006 | Inoue ..... B41J 11/0015 347/104 |
| 2007/0195145 | A1* | 8/2007 | Yamashita ..... B41J 2/2114 347/101 |
| 2007/0229586 | A1 | 10/2007 | Hirakawa |
| 2008/0055356 | A1 | 3/2008 | Yamanobe |
| 2008/0236480 | A1 | 10/2008 | Furukawa et al. |
| 2009/0079784 | A1 | 3/2009 | Chiwata et al. |
| 2011/0069109 | A1 | 3/2011 | Tojo |
| 2015/0015650 | A1* | 1/2015 | Landa ..... B41J 2/0057 347/103 |
| 2015/0306539 | A1 | 10/2015 | Yamato |
| 2016/0185110 | A1 | 6/2016 | Masuda et al. |
| 2017/0217216 | A1 | 8/2017 | Ohnishi et al. |
| 2018/0311951 | A1 | 11/2018 | Sakamoto et al. |
| 2018/0319179 | A1 | 11/2018 | Yamane et al. |
| 2018/0326755 | A1 | 11/2018 | Ohnishi et al. |
| 2018/0326756 | A1 | 11/2018 | Hirokawa et al. |
| 2018/0345702 | A1 | 12/2018 | Deguchi et al. |
| 2019/0001710 | A1 | 1/2019 | Hirokawa et al. |
| 2019/0009515 | A1 | 1/2019 | Deguchi et al. |
| 2019/0009546 | A1 | 1/2019 | Sakamoto et al. |
| 2019/0009549 | A1 | 1/2019 | Takada et al. |
| 2019/0009550 | A1 | 1/2019 | Inoue et al. |
| 2019/0009577 | A1 | 1/2019 | Hirokawa et al. |
| 2019/0009578 | A1 | 1/2019 | Takeuchi et al. |
| 2019/0009579 | A1 | 1/2019 | Inoue et al. |
| 2019/0009589 | A1 | 1/2019 | Hirokawa et al. |
| 2019/0009592 | A1 | 1/2019 | Okushima et al. |
| 2019/0009594 | A1 | 1/2019 | Sakamoto et al. |
| 2019/0016112 | A1 | 1/2019 | Tsushima et al. |

FOREIGN PATENT DOCUMENTS

| | | | |
|---|---|---|---|
| CN | 100546832 | C | 10/2009 |
| CN | 101607468 | A | 12/2009 |
| CN | 103660656 | A | 3/2014 |
| CN | 105593020 | A | 5/2016 |
| EP | 2 123 459 | A2 | 11/2009 |
| EP | 2 777 941 | A1 | 9/2014 |
| JP | 56-45773 | B2 | 10/1981 |
| JP | 2000-103157 | A | 4/2000 |
| JP | 2000-288483 | A | 10/2000 |
| JP | 2001-171143 | A | 6/2001 |
| JP | 2001-179959 | A | 7/2001 |
| JP | 2004-043047 | A | 2/2004 |
| JP | 2004-181955 | A | 7/2004 |
| JP | 2006-082428 | A | 3/2006 |
| JP | 2006-088486 | A | 4/2006 |
| JP | 2006-102981 | A | 4/2006 |
| JP | 2006-205677 | A | 8/2006 |
| JP | 2006-264080 | A | 10/2006 |
| JP | 2007-268974 | A | 10/2007 |
| JP | 2007-268975 | A | 10/2007 |
| JP | 4016559 | B2 | 12/2007 |
| JP | 2008-055852 | A | 3/2008 |
| JP | 2008-062199 | A | 3/2008 |
| JP | 2008-246787 | A | 10/2008 |
| JP | 2009-000915 | A | 1/2009 |
| JP | 2009-000916 | A | 1/2009 |
| JP | 2009-045851 | A | 3/2009 |
| JP | 2009-061644 | A | 3/2009 |
| JP | 2008-087283 | A | 4/2009 |
| JP | 2009-072927 | A | 4/2009 |
| JP | 2009-086348 | A | 4/2009 |
| JP | 2009-159116 | A | 7/2009 |
| JP | 2009-166387 | A | 7/2009 |
| JP | 2009-214439 | A | 9/2009 |
| JP | 2009-226852 | A | 10/2009 |
| JP | 2009-234219 | A | 10/2009 |
| JP | 2010-201796 | A | 9/2010 |
| JP | 2011-063001 | A | 3/2011 |
| JP | 2011-245865 | A | 12/2011 |
| JP | 2012-116617 | A | 6/2012 |
| JP | 2012-183798 | A | 9/2012 |
| JP | 2013-010267 | A | 1/2013 |
| JP | 2014-193599 | A | 10/2014 |
| JP | 2015-016687 | A | 1/2015 |
| JP | 2015-096562 | A | 5/2015 |
| JP | 2015-098097 | A | 5/2015 |
| JP | 2015-145117 | A | 8/2015 |
| JP | 2015-150789 | A | 8/2015 |
| JP | 2015-208881 | A | 11/2015 |
| JP | 2016-120625 | A | 7/2016 |
| WO | 2015034027 | A1 | 3/2015 |
| WO | 2018105215 | A1 | 6/2018 |

OTHER PUBLICATIONS

Singapore Search Report and Written Opinion dated Sep. 17, 2018, in SG Patent Application No. 11201805829P.
International Search Report and Written Opinion dated Mar. 24, 2017, in International Application No. PCT/JP2017/002666.
Chinese Office Action, dated Apr. 25, 2019, issued in Chinese Patent Application No. 201680078100.3.
Chinese Office Action, dated Apr. 25, 2019, issued in Chinese Patent Application No. 201680078027.X.
Chinese Office Action, dated Apr. 28, 2019, issued in Chinese Patent Application No. 201680078028.4.
Chinese Office Action, dated May 24, 2019, issued in Chinese Patent Application No. 201680078084.8.
Extended European Search Report, dated Jul. 11, 2019, issued in European Patent Application No. 16883554.4.
Extended European Search Report, dated Jul. 12, 2019, issued in European Patent Application No. 16883553.6.
Extended European Search Report, dated Jul. 12, 2019, issued in European Patent Application No. 16883551.0.
Extended European Search Report, dated Jul. 12, 2019, issued in European Patent Application No. 16883550.2.

(56) References Cited

OTHER PUBLICATIONS

Extended European Search Report, dated Jul. 23, 2019, issued in European Patent Application No. 16883546.0.
Extended European Search Report, dated Jul. 23, 2019, issued in European Patent Application No. 16883549.4.
International Search Report, dated Mar. 7, 2017, issued in International Patent Application No. PCT/JP2016/005241.
International Search Report, dated Mar. 28, 2017, issued in International Patent Application No. PCT/JP2016/005248.
International Search Report, dated Mar. 28, 2017, issued in International Patent Application No. PCT/JP2016/005246.
International Search Report, dated Mar. 7, 2017, issued in International Patent Application No. PCT/JP2016/005242.
International Search Report, dated Mar. 21, 2017, issued in International Patent Application No. PCT/JP2016/005247.
International Search Report, dated Mar. 7, 2017, issued in International Patent Application No. PCT/JP2016/005249.
International Search Report, dated Apr. 4, 2017, issued in International Patent Application No. PCT/JP2016/005251.
International Search Report, dated Mar. 28, 2017, issued in International Patent Application No. PCT/JP2016/005244.
International Search Report, dated Mar. 14, 2017, issued in International Patent Application No. PCT/JP2016/005250.

* cited by examiner

INK JET PRINTING APPARATUS

CROSS-REFERENCE TO RELATED APPLICATIONS

This application is a Continuation of International Patent Application No. PCT/JP2017/002666, filed Jan. 26, 2017, which claims the benefit of Japanese Patent Application Nos. 2016-016269, filed Jan. 29, 2016, 2016-016659, filed Jan. 29, 2016, 2016-026419, filed Feb. 15, 2016, 2016-107448, filed May 30, 2016, 2016-107960, filed May 30, 2016, and 2016-107962, filed May 30, 2016, all of which are hereby incorporated by reference herein in their entirety.

BACKGROUND OF THE INVENTION

Field of the Invention

The present invention relates to an ink jet printing apparatus.

Description of the Related Art

In an ink jet printing method, an image is formed by directly or indirectly applying a liquid composition (ink) containing a coloring material onto a printing medium such as paper. At this time, curling and cockling may occur due to excessive absorption of a liquid component in ink by the printing medium.

Here, in order to rapidly remove the liquid component in the ink, a method of drying a printing medium using units such as warm air or infrared rays or a method of forming an image on a transfer body, then drying a liquid component contained in the image on the transfer body by thermal energy or the like, and then transferring the image onto the printing medium such as paper is provided.

Further, as units for removing the liquid component contained in the image on the transfer body, a method of absorbing and removing the liquid component from the ink image by bringing a roller-shaped porous body into contact with the ink image without using thermal energy has been proposed (Japanese Patent Application Laid-Open No. 2009-45851).

In order to remove foreign matter such as dirt and dust adhering to a fiber sheet for cleaning a surface of a member such as a semiconductor substrate from the fiber sheet, a method of pressing a roller with an adhesive force against the surface of the fiber sheet has been proposed (Japanese Patent Application Laid-Open No. 2008-62199).

In a state where an object to be pressed against the adhesive roller is wet, the adhesive force of the adhesive roller is lower than that in a dry state. Therefore, in a case where the foreign matter is removed from the surface of the porous body in a state of being wet by absorbing an aqueous liquid component from an image, stronger adhesive force is required.

However, when cleaning is performed by pressing an adhesive roller having a strong adhesive force in a state where the porous body of the liquid absorbing member for absorbing the aqueous liquid component from the image is dry, the surface of the porous body wears, and the durability performance of the porous body is decreased in some cases. Further, in a case where the liquid absorbing member is formed of a composite member having a porous body adhered to a base material, when cleaning is performed with an adhesive roller having a strong adhesive force in a dry state, the porous body is peeled off from the base material in some cases.

An object of the present invention is to provide an ink jet printing apparatus having a porous body cleaning system capable of reducing damage to the porous body while maintaining removal performance of attached matters from a porous body included in a liquid absorbing member.

SUMMARY OF THE INVENTION

According to a first aspect, the present invention provides an ink jet printing apparatus including an image forming unit that includes an ink jet printing unit for applying ink containing an aqueous liquid medium and a coloring material on an ink receiving medium to form a first image containing an aqueous liquid component and the coloring material, a liquid absorbing unit that is provided with a liquid absorbing member including a porous body, which includes a liquid absorbing surface configured to be brought into contact with the first image, and which absorbs at least a portion of the aqueous liquid component from the first image via the liquid absorbing surface, a cleaning member that is disposed so as to be in contact with a liquid absorbing surface of the porous body and that has an adhesive force for removing attached matters from the liquid absorbing surface, acquisition units for acquiring information on a moisture amount in the porous body, a liquid application amount determining unit that determines a liquid application amount to be applied to the porous body from the liquid applying unit in order to bring the liquid absorbing surface of the porous body to be brought into contact with the cleaning member into a wet state for removing attached matters by the adhesive force based on the acquired information, and a liquid applying unit that applies an aqueous liquid to the porous body in accordance with the application amount determined by the liquid application amount determining unit.

According to a second aspect, the present invention provides an ink jet printing apparatus including an image forming unit that includes an ink jet printing unit for applying ink containing an aqueous liquid component and a coloring material on an ink receiving medium to form a first image containing the aqueous liquid component and the coloring material, a liquid absorbing unit that is provided with a liquid absorbing member including a porous body, which includes a liquid absorbing surface configured to be brought into contact with the first image, and absorbs at least a portion of the aqueous liquid component from the first image via the liquid absorbing surface, a cleaning member that is disposed so as to be in contact with the liquid absorbing surface of the porous body and that has an adhesive force for removing attached matters from the liquid absorbing surface, a moving control unit that brings the cleaning member into contact with the porous body in an image forming step, and that causes the cleaning member and the porous body to be separated from each other after completion of the image forming step, and a liquid applying unit that applies an aqueous liquid to the porous body in order to bring the porous body into a wet state for removing attached matters by the adhesive force, wherein the liquid applying unit applies the aqueous liquid to the porous body before the moving control unit brings the cleaning member into contact with the porous body.

Further features of the present invention will become apparent from the following description of exemplary embodiments with reference to the attached drawings.

DESCRIPTION OF THE EMBODIMENTS

Figure 1:
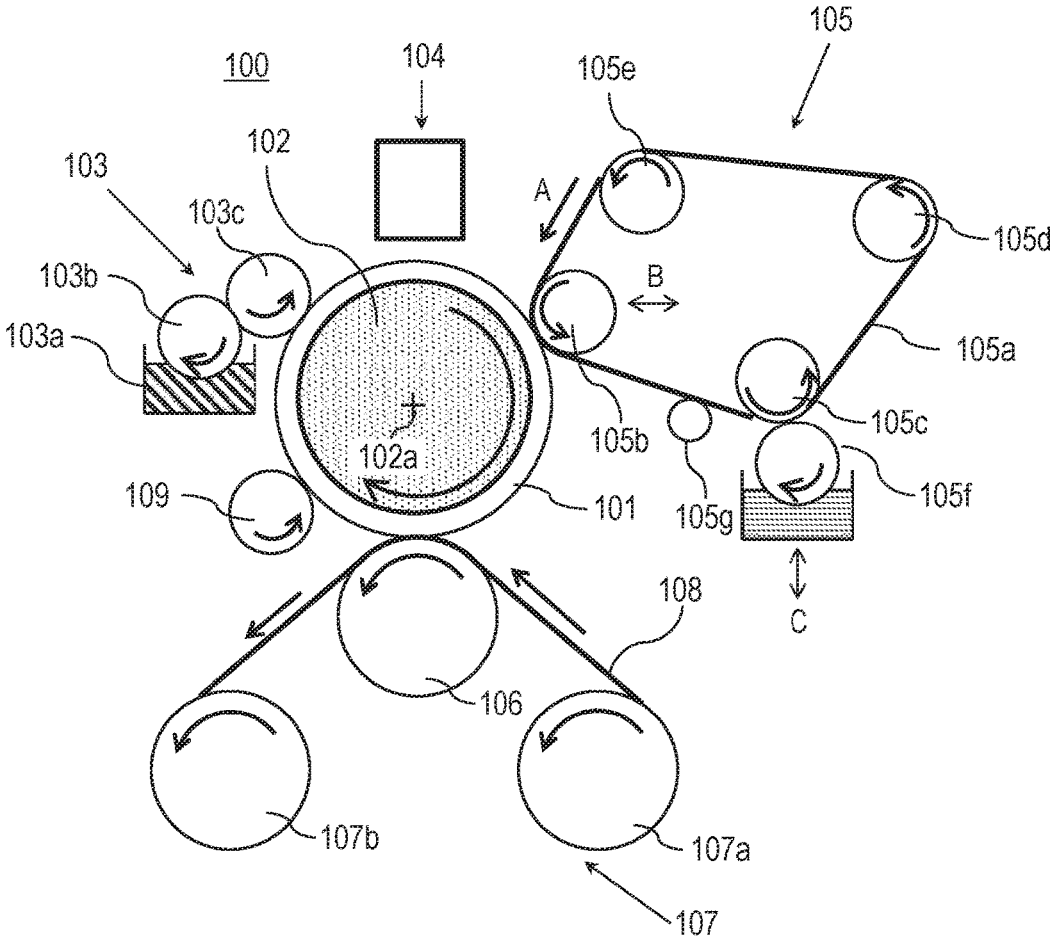
FIG. 1 is a schematic diagram illustrating one example of a configuration of a transfer type ink jet printing apparatus according to the present invention.

The ink jet printing apparatus according to the first aspect of the present invention includes an image forming unit that forms a first image containing an aqueous liquid component and a coloring material, and a liquid absorbing unit that is provided with a liquid absorbing member including a porous body absorbing at least a portion of the aqueous liquid component from the first image.

The porous body includes a liquid absorbing surface, and, when the liquid absorbing surface is configured to be brought into contact with the first image, and at least a portion of the aqueous liquid component is absorbed by the porous body from the first image via the liquid absorbing surface, a second image is formed from the first image.

The ink jet printing apparatus according to the present invention further includes a cleaning member that cleans the liquid absorbing surface of the porous body, a cleaning member moving control unit that allows the cleaning member to move in the apparatus, and a liquid applying unit that applies an aqueous liquid to the porous body. With this, a cleaning system of the porous body is configured.

The cleaning member is provided so as to abut the liquid absorbing surface of the porous body, and abuts the liquid absorbing surface of the porous body by the cleaning member moving control unit as necessary, or is separated from the liquid absorbing surface of the porous body.

The liquid applying unit applies the aqueous liquid to the porous body, and brings the porous body into a wet state. The liquid application amount of the aqueous liquid to the porous body from the liquid applying unit is so as to obtain a wet state for removing attached matters by the adhesive force of the cleaning member. This liquid application amount is determined by the liquid application amount determining unit in accordance with a moisture amount of the porous body.

The ink jet printing apparatus according to the second aspect of the present invention is the same as the ink jet printing apparatus according to the first aspect of the present invention from the viewpoint of including the image forming unit, the liquid absorbing unit, and the cleaning member in the first aspect. In the ink jet printing apparatus according to the second aspect of the present invention, operations of the cleaning member moving control unit and the liquid applying unit are different from those of the ink jet printing apparatus according to the first embodiment of the present invention. That is, in the ink jet printing apparatus according to the second aspect of the present invention, the cleaning member abuts the porous body at the time of image formation, and is separated from the porous body after completing the image formation. Further, the aqueous liquid is applied to the porous body from the liquid applying unit in order to bring the porous body into the wet state for removing the attached matters by the adhesive force before the cleaning member abuts on the porous body.

The image forming unit can include reaction liquid applying units for applying a reaction liquid containing an ink viscosity-increasing component to an ink receiving medium. When the first image is formed of ink and the reaction liquid, it is also possible to efficiently suppress bleeding, in which adjacent inks are applied and mixed with each other, or beading, in which the previously landed ink is attracted to the ink landed later.

The ink and the reaction liquid are applied to the ink receiving medium so that at least a portion of the applied ink and reaction liquid overlap with each other. An order of applying the ink and the reaction liquid to the ink receiving medium is not particularly limited. From the viewpoint of promoting the fixing of the coloring material of the first image and suppressing the occurrence of bleeding and beading, however, it is preferable to apply the ink after applying the reaction liquid to the ink receiving medium.

Note that, the first image is an ink image before liquid removal before being subjected to a liquid absorption treatment, and the second image, described later, is an ink image after liquid removal. That is, the second image is an ink image after liquid removal in which the content of the aqueous liquid component is reduced by performing the liquid absorption treatment.

Hereinafter, embodiments of the present invention will be described. In the following description, a "reaction liquid applying device" as the reaction liquid applying unit, an "ink applying device" as the ink jet printing unit, a "liquid absorbing device" as the liquid absorbing unit, and a "liquid applying device" as the liquid applying unit were respectively used.

The reaction liquid applying device may be any device as long as the reaction liquid can be applied onto the ink receiving medium, and various known devices can be appropriately used. Specifically, examples thereof include a gravure offset roller, an ink jet head, a die coating device (die coater) and a blade coating device (blade coater). The application of the reaction liquid by the reaction liquid applying device may be performed before application of the ink or after application of the ink as long as the reaction liquid on the ink receiving medium can be mixed (reacted) with the ink. The reaction liquid is preferably applied before the application of the ink. When the reaction liquid is applied before the application of the ink, it is also possible to more effectively suppress bleeding in which adjacently applied inks are mixed with each other or beading in which the previously landed ink is attracted to the ink landed later during the image printing by the ink jet method.

The reaction liquid contains an ink viscosity-increasing component for increasing the viscosity of the ink. The meaning of the viscosity increase of an ink includes at least one of the following descriptions (i) and (ii).

(i) A case where a coloring material, a resin or the like which is a portion of the components constituting the ink chemically reacts by contact with an ink viscosity-increasing component, or physically adsorbs the ink viscosity-increasing component, and as a result, an increase in the viscosity of an ink of the entire ink is observed.

(ii) A case where a viscosity increase locally occurs when a portion of the components such as the coloring material constituting the ink is aggregated.

The ink viscosity-increasing component has an effect of reducing the fluidity of a portion of the ink on the ink receiving medium so as to suppress bleeding and beading during the first image formation. Known materials such as a polyvalent metal ion, organic acid, a cationic polymer and a porous fine particle can be used as such an ink viscosity-increasing component. Among these, the polyvalent metal ion and the organic acid are particularly preferable. In addition, it is also preferable to include plural kinds of the ink viscosity-increasing components. Note that, the content of the ink viscosity-increasing component in the reaction liquid is preferably 5% by mass or more with respect to the total mass of the reaction liquid.

Examples of the polyvalent metal ion include divalent metal ions such as $Ca^{2+}$, $Cu^{2+}$, $Ni^{2+}$, $Mg^{2+}$, $Sr^{2+}$, $Ba^{2+}$ and $Zn^{2+}$ and trivalent metal ions such as $Fe^{3+}$, $Cr^{3+}$, $Y^{3+}$ and $Al^{3+}$.

Examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furancarboxylic acid, pyridine carboxylic acid, coumaric acid, thiophene carboxylic acid, nicotinic acid, oxysuccinic acid and dioxsuccinic acid.

The reaction liquid may contain water or an organic solvent of low volatility in an appropriate amount as an aqueous liquid medium. Water used in this case is preferably deionized water by ion exchange or the like. The organic solvent that can be used in the reaction liquid applied to the present invention is not particularly limited, and known organic solvents can be used.

The reaction liquid can be used by appropriately adjusting the surface tension and the viscosity by adding a surfactant or a viscosity adjusting agent. The material to be used is not particularly limited as long as it can coexist with the ink viscosity-increasing component. Specific examples of the surfactant to be used include a fluorine-based surfactant such as acetylene glycol ethylene oxide adduct ("Acetylenol E100", manufactured by Kawaken Fine Chemicals Co., Ltd., product name), and perfluoroalkyl ethylene oxide adduct ("Megafac F444", Manufactured by DIC Corporation, product name, "CapstoneFS-3100" manufactured by The Chemours Company LLC, product name, ZonylFS3100 manufactured by E. I. du Pont de Nemours and Company, product name, and the like) and a silicone-based surfactant such as polyether-modified polydimethylsiloxane adduct ("BYK 349" manufactured by BYK Co., Ltd., product name).

<Ink Applying Device>

An ink jet head is used as an ink applying device for applying ink. Examples of the ink jet head include a form in which ink is discharged by causing film boiling in the ink by an electro-thermal converter so as to form bubbles, a form in which ink is discharged by an electro-mechanical converter and a form in which ink is discharged by using static electricity. In the present invention, a known ink jet head can be used. Particularly, from the viewpoint of high-speed and high-density printing, one utilizing an electro-thermal converter is suitably used. The ink applying device receives an image signal and applies a necessary amount of ink to each position.

An ink applying amount can be expressed by the image density (duty) or the ink thickness In the present invention, however, an average value obtained by multiplying the mass of each of the ink dot by the number of ink dots to be applied and dividing by the printing area was set as the ink applying amount ($g/m^2$). Note that, from the viewpoint of removing the liquid component in the ink, the maximum ink applying amount in the image region indicates an ink applying amount applied in an area of at least equal to or larger than $5mm^2$ in a region used as information of the ink receiving medium.

The ink jet printing apparatus of the present invention may include a plurality of ink jet heads for applying various colors of ink onto the ink receiving medium. For example, in a case of forming respective color images using yellow ink, magenta ink, cyan ink, and black ink, the ink jet printing apparatus includes four ink jet heads that discharge each of the above four kinds of ink onto an ink receiving medium.

In addition, the ink applying member may include an ink jet head that discharges ink (clear ink) which does not contain a coloring material.

<Ink>

Each component of the ink applied to the present invention will be described.

(Coloring Material)

As the coloring material contained in the ink applied to the present invention, a pigment, or a mixture of a dye and a pigment can be used. The kinds of the pigments which can be used as a coloring material are not particularly limited. Specific examples of the pigment include an inorganic pigment such as carbon black, and an organic pigment, such as an azo-based organic pigment, a phthalocyanine-based organic pigment, a quinacridone-based organic pigment, an isoindolinone-based organic pigment, an imidazolone-based organic pigment, a diketopyrrolopyrrole-based organic pigment and a dioxazine-based organic pigment. These pigments may be used alone or, if necessary, one or two or more kinds thereof may be used in combination.

The kinds of the dyes which can be used as a coloring material are not particularly limited. Specific examples of the dye include direct dyes, acidic dyes, basic dyes, disperse dyes, edible dyes, and the like, and dyes having anionic groups can be used. Specific examples of the dye skeleton include an azo skeleton, a triphenylmethane skeleton, a phthalocyanine skeleton, an azaphthalocyanine skeleton, a xanthene skeleton, and an anthrapyridone skeleton.

The content of the pigment in the ink is preferably 0.5% by mass or more to 15.0% by mass or less, and is more preferably 1.0% by mass or more to 10.0% by mass or less with respect to the total mass of the ink.

(Dispersant)

As a dispersant for dispersing the pigment, a known dispersant used for ink jet ink can be used. In the embodiment of the present invention, it is particularly preferable to use a water-soluble dispersant having both a hydrophobic portion and a water repellent portion in the structure thereof. In particular, a pigment dispersant containing a resin obtained by copolymerizing at least a hydrophilic monomer and a water repellent monomer is preferably used. The monomers used here are not particularly limited, and known monomers are preferably used. Specific examples of the water repellent monomer include styrene and other styrene derivatives, alkyl (meth)acrylate, and benzyl (meth)acrylate. Examples of the hydrophilic monomer include acrylic acid, methacrylic acid and maleic acid.

The acid value of the dispersant is preferably 50 mgKOH/g or more to 550 mgKOH/g or less. In addition, a weight average molecular weight of the dispersant is preferably 1,000 or more to 50,000 or less. Note that, a mass ratio (pigment:dispersant) of the pigment to the dispersant is preferably in a range of 1:0.1 to 1:3.

In the present invention, it is also preferable to use a so-called self-dispersible pigment in which the pigment itself is surface-modified so that it can be dispersed without using a dispersant.

(Resin Fine Particle)

The ink applied to the present invention can contain various fine particles which do not contain coloring materials. Among these, the resin fine particle is effective in improving image quality and fixing property in some cases, and thus is preferable. The materials of the resin fine particles that can be used in the present invention is not particularly limited, and known resins can be appropriately used. Specific examples thereof include a homopolymer such as polyolefin, polystyrene, polyurethane, polyester, polyether, polyurea, polyamide, polyvinyl alcohol, poly (meth)acrylic acid, salts thereof, alkyl poly (meth)acrylate, and polydiene, or a copolymer obtained by polymerizing a combination of a plurality of monomers for producing these homopolymers. The weight average molecular weight of the resin (Mw) is preferably 1,000 or more to 2,000,000 or less. The amount of the resin fine particles in the ink is preferably 1% by mass or more to 50% by mass or less, and is more preferably 2% by mass or more to 40% by mass or less, with respect to the total mass of the ink.

Further, in the embodiment of the present invention, it is preferable to use the resin fine particle dispersion in which the resin fine particles are dispersed in a liquid. The method of dispersion is not particularly limited, and a so-called self-dispersible type resin fine particle dispersion which is dispersed using a resin obtained by homopolymerizing a monomer having a dissociable group or copolymerizing a plurality of kinds of monomers is suitable. Here, examples of the dissociable group include a carboxyl group, a sulfonic acid group and a phosphoric acid group, and examples of the monomer having such a dissociable group include acrylic acid and methacrylic acid. In addition, a so-called emulsion dispersible type resin fine particle dispersion in which the resin fine particles are dispersed with an emulsifier can likewise be suitably used in the present invention. A known surfactant is preferable as the emulsifier, regardless of low molecular weight and high molecular weight. The surfactant is preferably a nonionic surfactant or a surfactant which has the same electron as that of the resin fine particle.

The resin fine particle dispersion used in the embodiment of the present invention preferably has a dispersed particle diameter of 10 nm or larger to 1,000 nm or smaller, and more preferably has a dispersed particle diameter of 100 nm or larger to 500 nm or smaller.

In addition, when the resin fine particle dispersion is prepared, it is also preferable to add various additives for stabilization. Examples of such additives include n-hexadecane, dodecyl methacrylate, stearyl methacrylate, chlorobenzene, dodecyl mercaptan, blue dye (bluing agent) and polymethyl methacrylate.

(Surfactant)

The ink that can be used in the present invention may contain a surfactant. Specific examples of the surfactant include acetylene glycol ethylene oxide adduct (Acetylenol E100, manufactured by Kawaken Fine Chemicals Co., Ltd.) and the like. The amount of the surfactant in the ink is preferably 0.01% by mass or more to 5.0% by mass or less with respect to the total mass of the ink.

(Water and Water-soluble Organic Solvent)

The aqueous liquid medium of the ink is a liquid medium containing at least water. As the ink containing the aqueous liquid medium, that is, as an aqueous ink, it is possible to use an aqueous pigment ink containing at least a pigment as the coloring material.

The aqueous liquid medium can further contain a water-soluble organic solvent as necessary. Water is preferably deionized water by ion exchange or the like. In addition, the content of the water in the ink is preferably 30% by mass or more to 97% by mass or less with respect to the total mass of the ink.

Further, the kinds of the water-soluble organic solvent to be used are not particularly limited, and any of known organic solvents can be used. Specific examples thereof include glycerin, diethylene glycol, polyethylene glycol, polypropylene glycol, ethylene glycol, propylene glycol, butylene glycol, triethylene glycol, thiodiglycol, hexylene glycol, ethylene glycol monomethyl ether, diethylene glycol monomethyl ether, 2-pyrrolidone, ethanol and methanol. Of course, it is also possible to mix and use two or more kinds selected from them.

In addition, the content of the water-soluble organic solvent in the ink is preferably 3% by mass or more to 70% by mass or less with respect to the total mass of the ink.

(Other Additives)

In addition to the above components, as necessary, the ink that can be used in the present invention may contain other additives such as a pH adjuster, a rust preventive, an antiseptic, a mildewproofing agent, an antioxidant, a reduction preventing agent, a water soluble resin and its neutralizing agent, a viscosity adjusting agent, and the like.

When the first image is brought into contact with the porous body included in the liquid absorbing member, at least a portion of the aqueous liquid component is absorbed by the porous body from the first image. With this, the liquid amount in the first image is decreased. A surface of the porous body including by the liquid absorbing member for contact with the first image functions as a liquid absorbing surface (hereinafter, referred to as "first surface").

(Porous Body)

In order to suppress the adhesion of the ink coloring material, the porous body preferably has a small pore diameter, and a pore diameter of the porous body on at least the side in contact with the image is preferably 10 μm or smaller. On the other hand, in order to improve the absorbability of the liquid component to the porous body, an average pore diameter of the porous body on the first surface side in contact with at least an image is preferably 0.05 μm or larger.

In the present invention, the pore diameter means the average diameter, and can be measured by known means such as a mercury intrusion method, a nitrogen adsorption method, and a SEM image observation.

In addition, in order to uniformly provide high air permeability, it is preferable to reduce the thickness of the porous body. Air permeability can be indicated by the GURLEY value defined in JIS P8117, and the Gurley value is preferably equal to or shorter than 10 seconds. The shape of the porous body is not particularly limited, and may be a roller shape, a belt shape, an endless belt shape, a sheet shape and the like.

However, if the porous body is thinned, the capacity necessary for absorbing the aqueous liquid component cannot be sufficiently ensured in some cases, so that it is possible to make the porous body into a multilayer structure. Also, as the liquid absorbing member, a layer which is configured to be brought into contact with the image on the transfer body may be a porous body, and a layer which is configured not to be brought into contact with the image on the transfer body may not be a porous body.

The method of preparing the porous body is not particularly limited and any of the conventionally widely used manufacturing methods can be applied. As an example, Japanese Patent No. 1114482 discloses a method of preparing a porous body obtained by biaxially stretching a resin containing polytetrafluoroethylene.

In the present invention, the material for forming the porous body is not particularly limited, and any of a hydrophilic material having a contact angle to water of less than 90° and a water repellent material having a contact angle of equal to or larger than 90° is used.

In a case of a hydrophilic material, the contact angle to water is more preferably equal to or smaller than 40°. In the case of the hydrophilic material, it has an effect of suctioning the liquid by a capillary force.

Examples of the hydrophilic material include polyolefin (such as polyethylene (PE)), polyurethane, nylon, polyamide, polyester (polyethylene terephthalate (PET) or the like) and polysulfone (PSF).

From the viewpoint of obtaining releasability of the coloring material contained in the first image, the porous body preferably has water repellency. In the porous body having the water repellency, the contact angle of pure water is preferably equal to or larger than 90°. As a result of intensive investigations by the inventors of the present invention, it was found that by using a porous body having a contact angle with pure water of 90° or more, it is possible to suppress the adhesion of the ink coloring material to the porous body. The contact angle in this specification means an angle formed by dropping a measurement liquid onto a target and making a tangent of the droplet with a surface of the target at a portion where the droplet is in contact with the target. Although there are several kinds of measurement techniques, the inventors of the present invention measured the water repellency according to the technique disclosed in "6. Static Method" of JIS R3257.

The material of the water repellent porous body is not particularly limited as long as the contact angle with the ink is 90° or more, but it is preferably made of a water repellent resin material. Further, it is preferable that the water repellent resin material is a fluororesin. Specific examples of the fluororesin include polytetrafluoroethylene (PTFE), polychlorotrifluoroethylene (PCTFE), polyvinylidene fluoride (PVDF), polyvinyl fluoride (PVF), perfluoroalkoxy fluororesin (PFA), a tetrafluoroethylene-propylenehexafluoride copolymer (FEP), an ethylene-tetrafluoroethylene copolymer (ETFE) and an ethylene chlorotrifluoroethylene copolymer (ECTFE). One or two or more kinds of these resins can be used as necessary, or a structure in which a plurality of films are laminated may be used. Among them, polytetrafluoroethylene is preferable.

<Multilayer Configuration>

Next, embodiments in a case where the porous body has a multilayer configuration will be described. Here, a first layer on the side abutting on the first image, and as a second layer, a layer laminated on the side opposite to the contact surface with the first image of the first layer will be described. Further, the configuration of the multilayer is sequentially expressed in the order of lamination from the first layer. In this specification, the first layer may be referred to as an "absorbing layer" and the second layer and subsequent layers may be referred to as a "supporting layer".

[First Layer]

The first layer can be formed from the porous body described above in the section "(Porous body)".

From the viewpoint of suppressing coloring material adhesion and enhancing the cleaning property, it is preferable to use the above-described water repellent porous body for the first layer. One or two or more kinds of these resins can be used as necessary, or a structure in which a plurality of films in the first layer are laminated may be used.

In a case of using a porous body formed of a water repellent material, it is preferable to perform a pretreatment described later.

In the present invention, a film thickness of the first layer is preferably 50 μm or smaller. The film thickness is more preferably 30 μm or smaller. The film thickness can be obtained by measuring the film thickness of optional 10 points with a straight type micrometer (OMV-25, manufactured by Mitutoyo Corporation) and calculating the average value thereof.

The first layer can be produced by a known method for producing a thin film porous membrane. For example, it can be obtained by molding a resin material into a sheet shape by a method such as extrusion molding, and stretching to a predetermined thickness. Further, a plasticizer such as paraffin is added to a material at the time of extrusion molding, and the plasticizer is removed by heating or the like at the time of stretching so as to obtain a porous film. The pore diameter can be adjusted by appropriately adjusting the amount of the plasticizer to be added, a draw ratio, and the like.

[Second Layer]

In the present invention, the second layer is preferably a layer having air permeability. Such a layer may be a nonwoven fabric of a resin fiber or a woven fabric. The material of the second layer is not particularly limited, and is preferably a material in which the contact angle with the aqueous liquid component absorbed from the image with respect to the first layer is the same as or lower than that of the liquid absorbed to the first layer side so that the liquid absorbed to the first layer side does not flow backward. Specifically, the material of the second layer is preferably selected from a single material such as polyolefin (such as polyethylene (PE), polypropylene (PP)), polyurethane, nylon, polyamide, polyester (polyethylene terephthalate (PET), and the like), and polysulfone (PSF), or composites thereof. In addition, the second layer is preferably a layer having a pore diameter larger than that of the first layer.

[Third Layer]

In the present invention, the porous body of the multilayer structure may have a configuration having three or more layers, and the number of layers is not limited. A nonwoven fabric is preferable as a layer after a third layer (also, referred to as a third layer) in view point of rigidity. The material which is the same as the second layer can be used.

[Other Materials]

The liquid absorbing member may have a reinforcing member for reinforcing the side surface of the liquid absorbing member in addition to the porous body having the laminated structure. Further, the liquid absorbing member may have a joining member for joining longitudinal end portions of a long sheet-shaped porous body to form a belt-like member. As such a material, a non-porous tape material or the like can be used, and may be disposed at a position or a period where the material is not in contact with the image.

[Method of Producing Porous Body]

The method of forming the porous body by laminating the first layer and the second layer is not particularly limited. The first layer and the second layer may be overlapped or adhered to each other by using a method such as lamination by adhesive agent and lamination by heating. From the viewpoint of the air permeability, the lamination by heating is preferable in the present invention. In addition, for example, a portion of the first layer or the second layer may be melted and the first layer and the second layer may be bonded and laminated by heating. Alternatively, a fusing material such as a hot melt powder may be interposed between the first layer and the second layer such that the first layer and the second layer are adhered to each other by heating and thus are laminated. In the case of laminating the third or more layers, they may be laminated at once or may be laminated in order, and the order of laminating is appropriately selected. In the heating step, a lamination method of heating the porous body by sandwiching the porous body with the heated roller in a pressurized state is preferable.

<Cleaning System of the Porous Body>

(Porous Body Cleaning Member)

A cleaning member for cleaning the first surface of the porous body is not particularly limited as long as it has a contact portion with the porous body in which attached matters attached to the first surface of the porous body, for example, solid components such as coloring materials and resins supplied by aqueous ink are removed by the adhesive force. For example, it is possible to use a cleaning member in which a pressure-sensitive adhesive layer is formed at the contact portion with the first surface of the porous body on the base material. From the viewpoint of performing efficient cleaning, it is possible to suitably use an adhesive roller provided with an adhesive layer on the peripheral surface of the roller.

The adhesive constituting the adhesive layer can be used without particular limitation as long as it has an adhesive force for effectively removing attached matters on the first surface of the porous body in the wet state. With a commercially available or known adhesive, preferably a hydrophobic adhesive, it is possible to select and use those obtaining the objective effect in the present invention.

(Porous Body Cleaning Member Moving Control Unit)

The porous body cleaning member is provided so as to be able to abut on the first surface of the porous body in the ink jet printing apparatus. The movement of the porous body cleaning member is performed by the cleaning member moving control unit. With this cleaning moving control unit, the cleaning member is allowed to abut on the first surface of the porous body at the time of image formation, and can be moved to a position which is separated from the first surface of the porous body after completing the image formation.

(Liquid Applying Device)

The adhesive force of the cleaning member is set so as to remove attached matters attached to the first surface of the porous body in the wet state, and in a case where the moisture amount of the porous body is small or in a case where the porous body is dried, damages such as abrasion and peeling of the first surface of the porous body occur. Here, before performing the cleaning treatment by allowing the cleaning member to abut the first surface of the porous body, the aqueous liquid is applied to the porous body so as to set the porous body to be in the wet state suitable for removal of attached matters by the adhesive force of the cleaning member.

The liquid applying device may be any device as long as the aqueous liquid can be applied to the porous body, and various known devices can be appropriately used. Specifically, examples thereof include a gravure offset roller, an ink jet head, a die coating device (die coater), and a blade coating device (blade coater). Note that a pretreatment device to be described later may have a function as a liquid applying device.

(Aqueous Liquid)

The aqueous liquid to be applied to the porous body from the liquid applying device contains at least water and is capable of imparting a wet state to the porous body for favorably performing the cleaning treatment of the porous body with the adhesive force of the cleaning member. The aqueous liquid preferably contains water and a water-soluble organic solvent. Water is preferably deionized water by ion exchange or the like. Further, the kinds of the water-soluble organic solvent to be used are not particularly limited, and any of known organic solvents such as ethanol and isopropyl alcohol can be used.

In a case of the water repellent porous body, it is preferable that at least one of a silicone-based surfactant and a fluorine-based surfactant is added to the aqueous liquid, as necessary, to improve permeability into the porous body. A liquid contained in the surfactant, and has a contact angle of lower than 90° with respect to the first surface of the porous body may be used.

A position in which the liquid applying device is installed may be a position where the aqueous liquid can be supplied to the porous body.

(Liquid Application Amount Determining Unit)

In performing the cleaning treatment with the cleaning member, the amount (amount of applied liquid) of the aqueous liquid to be applied to the porous body before abutting on the first surface of the porous body of the cleaning member is determined by the liquid application amount determining unit. The function of this liquid application amount determining unit is realized by ASIC 404 or CPU 401.

A method of determining the moisture amount of the porous body to be cleaned is not particularly limited, and it can be selected from various methods and used. As a method of acquiring information on the moisture amount in the porous body, for example, the following method can be used.

(1) A method of calculating the moisture amount of the porous body using the elapsed time from the end of the previous image forming step to the start of the subsequent image forming step.

(2) A method of calculating the moisture amount of the porous body using a moisture meter.

When an image is formed by operating the ink jet printing apparatus, at least a portion of the aqueous liquid component is absorbed into the porous body from the image, and the porous body contains moisture. In a case where a plurality of image forming steps are performed at a time interval, there is no supply of moisture to the porous body between the previous image forming step and the subsequent image forming step, and when the time between this two steps becomes longer, the moisture amount of the porous body may be decreased and thereby the porous body may be further dried in some cases. Examples of the temporal intervals include an apparatus pausing (standby) time in the standby state of the ink jet printing apparatus and an apparatus stop time in which a power supply is stopped in an OFF state.

In the above-described method (1), the moisture amount of the porous body at the end of the previous image forming step and an evaporation rate of the moisture from the porous body in installation environment in the ink jet printing apparatus are measured in advance. Based on the moisture amount of the porous body at the end of the previous image forming step, the evaporation rate of the moisture, and the elapsed time from the end of the previous image forming step to the start of the subsequent image forming step, it is possible to calculate the moisture amount of the porous body required at the start of the subsequent image forming step. Calculation of the moisture amount of the porous body can be performed by the liquid application amount determining unit.

The elapsed time can be measured using a time measuring unit such as a counter that counts the time from the end of the previous image forming step to the start of the subsequent image forming step.

The moisture amount of the previous porous body can be calculated from the amount used in the previous image forming step of the aqueous ink to the ink receiving medium and the reaction liquid applied as necessary, and the number of contact times of the porous body with the first image.

The evaporation rate of moisture from the porous body can be determined by an experiment in which various kinds of moisture amounts contained in the porous body used in the apparatus are attempted and the drying rate at each moisture amount is determined by measuring the change in weight of the porous body in the environment where moisture evaporation occurs. The drying rate corresponding to the moisture amount of the porous body at the end of the previous image forming step obtained as described above is selected from the drying rate corresponding to each moisture amount thus obtained so as to be used for calculating the moisture amount of the porous body at the start of the subsequent image forming step in the liquid application amount determining unit.

The adhesive force of the porous body cleaning member is set so that attached matters can be removed from the porous body in the wet state at the time of the image formation. In a case where the elapsed time from the end of the previous image formation is short and the moisture amount of the porous body is sufficient for the cleaning treatment by the adhesive force, the application amount of the aqueous liquid to the porous body is set to "0" (zero), and the application of the aqueous liquid to the porous body can be omitted.

It is possible to determine whether or not the application amount of the aqueous liquid is set to "0" (zero) by setting a threshold value. A method of setting this threshold value is not particularly limited. For example, a threshold value can be determined by using a method of determining a threshold value in advance by preparing an experiment model from the cleaning member such as the adhesive roller and the porous body, and variously changing the moisture holding amount of the porous body so as to confirm the cleaning effect in advance.

In a case where this elapsed time becomes longer and the moisture amount of the porous body is small or in a case of being in the dry state, the above-described problem occurs. In such a case, the aqueous liquid is applied to the porous body from the liquid applying unit, and the porous body is brought into the wet state suitable for the cleaning treatment by the adhesive force. In other words, the amount of liquid held in the porous body is controlled by adjusting the liquid application amount when applying the aqueous liquid to the porous body from the liquid applying unit.

In the above-described method (1), it is preferable to calculate the moisture amount of the porous body taking into consideration of temperature and humidity of the installation environment of the porous body in the ink jet printing apparatus. The temperature and humidity around the porous body can be measured by providing these measuring devices in an ink jet printing apparatus. The temperature and humidity measured by the measuring device are used to calculate the liquid application amount in the liquid application amount determining unit. Either temperature or humidity may be used.

As a simple method of the above-described method (1), a method described in Example 1 described later can be used. That is, a relationship between the number of rotations of the liquid absorbing member (the number of repeated use at the same place) and the standby time as indicated in Table 1 is set in advance, and the standby time and the application amount the aqueous liquid required in accordance with the standby time are obtained in advance. The application amount of the aqueous liquid can be obtained from, for example, the number of rotations of the endless belt-like liquid absorbing member at the time of applying the aqueous liquid. The number of rotations of the liquid absorbing member at the time of applying the aqueous liquid can be determined according to the actually measured standby time from the application amount of the aqueous liquid which has been obtained in advance.

In the present invention, the "image forming step" refers to a step of forming a single image or a plurality of images. The image formed in this image forming step can be variously selected according to the design of the printing apparatus. For example, as the image formed in the image forming step, it is possible to select from the first image, the second image and the final image to be used for the intended use. In a case of a transfer type printing apparatus which will be described later, the final image is an image (third image) transferred to a printing medium and fixed on the printing medium, and in a case of a direct drawing type printing apparatus, the final image is a second image.

"At the end of the previous image forming step" means the end of the image forming step described above.

In a case where the image formed in the image forming step is the second image, "the end of the previous image forming step" is the start of counting the standby time of the liquid absorbing operation of the liquid absorbing member having the porous body. Further, in a case where the image formed in the image forming step is the third image in the transfer type printing apparatus, "at the end of the previous image forming step" can be the start of stopping the operation of the transfer body.

In addition, "at the start of the subsequent image forming step" is the start of a new image forming step with the elapse of time from "at the end of the previous image forming step" described above.

Further, during the initial operation of the printing apparatus, maintenance of the porous body at the start of the subsequent image forming step can be performed as necessary.

Specific embodiments of an ink jet printing apparatus of the present invention can be applied will be described.

As the ink jet printing apparatus of the present invention, apparatus of the following types can be exemplified.

(A) An ink jet printing apparatus for forming a first image on a transfer body as an ink receiving medium and transferring a second image after the aqueous liquid component has been absorbed by a liquid absorbing member onto the receiving medium.

(B) An ink jet printing apparatus for forming a first image on a printing medium as an ink receiving medium.

In the present invention, the former ink jet printing apparatus will hereinafter be referred to as a transfer type ink jet printing apparatus for the sake of convenience, and the latter ink jet printing apparatus is hereinafter referred to as a direct drawing type ink jet printing apparatus for the sake of convenience.

Each ink jet printing apparatus will be described below.

(Transfer-type Ink Jet Printing Apparatus)

In the transfer type ink jet printing apparatus, the ink receiving medium is a transfer body for temporarily holding a first image and a second image obtained by absorbing at least a portion of an aqueous liquid component from the first image. The transfer type ink jet printing apparatus includes a transfer unit including a transfer member that transfers the second image onto a printing medium on which an image is to be formed, that is, a printing medium for forming a final image according to the intended use.

FIG. 1 is a schematic diagram illustrating one example of a schematic configuration of a transfer type ink jet printing apparatus 100 of the present embodiment.

The illustrated transfer type ink jet printing apparatus has a transfer unit including a transfer body 101 supported by a support member 102, a reaction liquid applying device 103, an ink applying device 104, a liquid absorbing device 105, and a transfer member 106. The application of the reaction liquid performed on the transfer body 101 by the reaction liquid applying device 103, and the ink is applied from the ink applying device 104 on the transfer body 101 to which the reaction liquid is applied, and a first image is formed on the transfer body. The first image on the transfer body becomes the second image by absorbing the aqueous liquid component by the liquid absorbing device 105 from the first image. The second image on the transfer body is transferred by a transfer unit including the transfer member 106 on the printing medium 108, such as paper.

In addition, the transfer type ink jet printing apparatus 100 may include a transfer body cleaning member 109 for cleaning the surface of the transfer body 101 after the transfer as necessary.

The support member 102 rotates about a rotation axis 102*a* in the direction of an arrow in FIG. 1. With the rotation of the support member 102, the transfer body 101 is rotationally moved. The application of the reaction liquid by the reaction liquid applying device 103 and the application of the ink by the ink applying device 104 are sequentially performed on the transfer body 101 to be moved, and thereby, the first image is formed on the transfer body 101. The first image formed on the transfer body 101 is moved to a position where the first image comes into contact with the liquid absorbing member 105*a* of the liquid absorbing device 105 by the rotational movement of the transfer body 101.

The liquid absorbing member 105*a* of the liquid absorbing device 105 moves in synchronization with the transfer body 101 to be conveyed in the direction of an arrow A, and the first image passes through a state of being in contact with the moving liquid absorbing member 105*a*. During this time, the liquid absorbing member 105*a* removes at least the aqueous liquid component from the first image.

Note that, the liquid component contained in the first image is removed by passing through the state of being in contact with the liquid absorbing member 105*a*. In this case, in the configuration of the present apparatus, it is particularly preferable that the liquid absorbing member 105*a* and the first image are in a state of being brought into contact with each other with a predetermined pressing force in order to effectively function the liquid absorbing member 105*a*.

The removal of the aqueous liquid component can be expressed from a different point of view as concentrating the ink constituting the first image formed on the transfer body. Concentrating the ink means that the proportion of the solid content contained in the ink, such as coloring material and resin, with respect to the aqueous liquid component contained in the ink increases owing to a reduction in the aqueous liquid component.

Then, the image having the aqueous liquid component removed is moved by the movement of the transfer body 101 to the transfer unit, which is in contact with the printing medium, and is brought into contact with the printing medium conveyed to the transfer unit by the printing medium conveyance device 107, and thereby, an image is formed on the printing medium. The image transferred onto the printing medium 108 is a reverse image of the second image, and may be referred to as a third image separately from the first image (the ink image before liquid removal) and the second image (the ink image after liquid removal), as described above.

Note that, since the image is formed by applying ink after the reaction liquid is applied onto the transfer body, the reaction liquid remains in the non-image region without reacting with the ink. In this apparatus according to the present embodiment, the liquid absorbing member 105*a* is in contact with not only the image but also the unreacted reaction liquid, and the reaction liquid itself or the liquid components contained in the reaction liquid are also removed.

Therefore, it is expressed and described that the aqueous liquid component is removed from the image, but this is not limited to the meaning that the aqueous liquid component is removed from only the image, but means that a liquid component is removed from at least the image on the transfer body in a case of using the reaction liquid in combination. For example, it is possible to remove the liquid component in the reaction liquid applied to the outer region of the first image together with the first image.

Note that, the liquid component is not particularly limited as long as it does not have a certain shape, has fluidity, and has a substantially constant volume.

Examples of the liquid component include water, an organic solvent, and the like contained in the ink, a reaction liquid itself, and water and an organic solvent contained in the reaction liquid, and in a case of using the reaction liquid in combination, at least a portion of these reaction components is removed from the transfer body by the liquid absorbing member.

Also, even in a case where the clear ink is contained in the first image, it is possible to concentrate the ink by the liquid absorption treatment. For example, when the clear ink is entirely applied onto the color ink containing the coloring material applied onto the transfer body 101, the clear ink is present on the entire surface of the first image, or the clear ink is partially present at one or more places on the surface of the first image, and the color ink is present in another portion of the first image. In the first image, in the places where the clear ink is present on the color ink, the porous body absorbs the liquid component of the clear ink on the surface of the first image and the liquid component of the clear ink moves. Accordingly, the liquid component in the color ink moves to the porous body side, and thereby, the aqueous liquid component in the color ink is absorbed. On the other hand, in a case where the clear ink and the color ink are mixed on the surface of the first image, the respective liquid components of the color ink and the clear ink move to the porous body side, and thereby, the aqueous liquid component is absorbed. Note that, the clear ink may contain a large amount of components for improving transferability of the image from the transfer body 101 to the printing medium. For example, the content of the component that increases the adhesiveness by heating may be greater than that of the color ink.

Each configuration of the transfer type ink jet printing apparatus of this embodiment will be described below.

<Transfer Body>

A transfer body 101 includes a surface layer including an image forming surface. As a member of the surface layer, various materials such as a resin and ceramics can be appropriately used, but from the viewpoint of durability and the like, a material having high compressive elastic modulus is preferable. Specifically, examples thereof include a condensate obtained by condensing an acrylic resin, an acrylic silicone resin, a fluorine-containing resin, and a hydrolyzable organosilicon compound. In order to improve the wettability and the transferability of the reaction liquid, the surface treatment may be performed before use. Examples of the surface treatment include a frame treatment, a corona treatment, a plasma treatment, a polishing treatment, a roughening treatment, an active energy ray irradiation treatment, an ozone treatment, a surfactant treatment and a silane coupling treatment. These may be combined in plural. An optional surface shape can also be provided on the surface layer.

Further, it is preferable that the transfer body includes a compressible layer having a function of absorbing pressure variation. When the compressible layer is provided, the compressible layer absorbs the deformation, disperses the variation against local pressure variation, and maintains excellent transferability even during high-speed printing. Examples of members of the compressible layer include acrylonitrile-butadiene rubber, acrylic rubber, chloroprene rubber, urethane rubber and silicone rubber. It is preferable that at the time of molding the rubber material, a predetermined amount of a vulcanizing agent, a vulcanization accelerator and the like are blended and a filler such as a foaming agent, a hollow fine particle or salt is further blended, as necessary, to make the rubber material porous. As a result, a bubble portion is compressed with volume change for various pressure fluctuations, so that deformation in a direction other than the compression direction is small and a more stable transferability and the durability can be obtained. As the porous rubber material, there are one having continuous pore structure in which the pores are continuous to each other and one having independent pore structure in which the pores are independently separated from each other. In the present invention, any structure may be used, and these structures may be used in combination.

Further, the transfer body preferably includes an elastic layer between the surface layer and the compressible layer. As a member of the elastic layer, various materials such as resin, ceramics and the like can be appropriately used. Various elastomer materials and rubber materials are preferably used from the viewpoint of processing characteristics and the like. Specific examples thereof include fluorosilicone rubber, phenyl silicone rubber, fluororubber, chloroprene rubber, urethane rubber, nitrile rubber, ethylene propylene rubber, natural rubber, styrene rubber, isoprene rubber, butadiene rubber, a copolymer of ethylene/propylene/butadiene and nitrile butadiene rubber. In particular, silicone rubber, fluorosilicone rubber and phenyl silicone rubber are preferable in terms of dimensional stability and the durability because of small compression set. In addition, the change in the elastic modulus due to temperature is small, which is also preferable from the viewpoint of transferability.

Various adhesives or double-sided tapes may be used between the layers constituting the transfer body (the surface layer, the elastic layer and the compressible layer) in order to fix and hold the layers. A reinforcing layer having a high compressive elastic modulus may be provided for suppressing lateral elongation when being mounted on the device and for maintaining elasticity. Further, the woven fabric may be used as a reinforcing layer. The transfer body can be produced by optionally combining each layer by the above-described material.

The size of the transfer body can be freely selected according to the size of the target print image. The shape of the transfer body is not particularly limited, and specifically, examples thereof include a sheet shape, a roller shape, a belt shape and an endless web shape.

<Support Member>

The transfer body 101 is supported on the support member 102. As a method of supporting the transfer body, various adhesives or double-sided tapes may be used. Alternatively, by attaching a mounting member made of a material such as metal, ceramic and a resin to the transfer body, the transfer body may be supported on the support member 102 using the mounting member.

The support member 102 is required to have a certain degree of structural strength from the viewpoint of conveying accuracy and durability. For the material of the support member, metal, ceramic, resin, or the like is preferably used. Among them, in particular, in order to improve responsiveness of control by reducing inertia during operation in addition to rigidity and dimensional accuracy that can withstand pressurization at the time of transfer, aluminum, iron, stainless steel, acetal resin, epoxy resin, polyimide, polyethylene, polyethylene terephthalate, nylon, polyurethane, silica ceramics alumina ceramics are preferably used. Further, these are preferably used in combination.

<Reaction Liquid Applying Device>

The ink jet printing apparatus of the present embodiment includes the reaction liquid applying device 103 for applying the reaction liquid to the transfer body 101. The reaction liquid applying device 103 illustrated in FIG. 1 indicates a gravure offset roller which is provided with a reaction liquid storing unit 103*a* for storing the reaction liquid and reaction liquid applying units 103*b* and 103*c* for applying the reaction liquid in the reaction liquid storing member 103*a*onto the transfer body 101.

<Ink Applying Device>

The ink jet printing apparatus of the present embodiment includes an ink applying device 104 that applies ink to the transfer body 101 to which the reaction liquid is applied. The first image is formed by mixing the reaction liquid and the ink, and in the subsequent liquid absorbing device 105, the aqueous liquid component is absorbed from the first image.

<Liquid Absorbing Device>

In this embodiment, the liquid absorbing device 105 includes the liquid absorbing member 105*a* and a pressing member 105*b* for liquid absorption which presses the liquid absorbing member 105*a* against the first image on the transfer body 101.

It is possible to perform a liquid absorption treatment from the first image by allowing the first image to pass through a nip portion formed when the first surface is brought into contact with the outer peripheral surface of the transfer body 101 by operating the pressing member 105*b* to press the second surface of the liquid absorbing member 105*a*. A region where the liquid absorbing member 105*a* can be pressed and brought into contact with the outer peripheral surface of the transfer body 101 as a liquid absorption treatment region.

The position of the pressing member 105*b* with respect to the transfer body 101 and the pressurizing of the pressing member 105 against the transfer body 101 can be adjusted by position control and a pressurizing mechanism (not shown). For example, it is possible to make the pressing member 105*b* reciprocatable in the direction of an arrow B indicated in the drawing, and the liquid absorbing member 105*a* can be brought into contact with the outer peripheral surface of the transfer body 101 at the timing when the liquid absorption treatment is required and can be separated from this outer peripheral surface.

Note that, the shapes of the liquid absorbing member 105*a* and pressing member 105*b* are not particularly limited. For example, as illustrated in FIG. 1, a configuration in which the pressing member 105*b* has a columnar shape, the liquid absorbing member 105*a* has a belt shape, and the liquid absorbing member 105*a* having the belt shape is pressed against the transfer body 101 by the pressing member 105*b* having the columnar shape may be employed. In addition, a configuration in which the pressing member 105*b* has a columnar shape, the liquid absorbing member 105*a* has a cylindrical shape formed on the peripheral surface of the pressing member 105*b* having the columnar shape, and the liquid absorbing member 105*a* having the cylindrical shape is pressed against the transfer body by the pressing member 105*b* having the columnar shape may be employed.

In the present invention, it is preferable that the liquid absorbing member 105*a* has the belt shape in consideration of the space and the like in the ink jet printing apparatus.

In addition, the liquid absorbing device 105 which includes the liquid absorbing member 105*a* having such a belt shape may include an extending member for extending the liquid absorbing member 105*a*. In FIG. 1, reference numerals 105*c*, 105*d* and 105*e* represent an extending roller as the extending member. These rollers and the belt-shaped liquid absorbing member 105*a* stretched around these rollers constitute a conveyance unit that conveys the porous body for performing the liquid absorption treatment from the first image. With this conveyance unit, it is possible to carry in, carry out and retransmit the porous body to a liquid absorption treatment region.

In FIG. 1, the pressing member 105*b* is also a roller member that rotates similarly to the extending roller, but the present invention is not limited thereto.

In the liquid absorbing device 105, when the liquid absorbing member 105*a* including the porous body is pressed to the first image by the pressing member 105*b*, the aqueous liquid component contained in the first image is absorbed to the liquid absorbing member 105*a*, and thereby the aqueous liquid component is removed from the first image. As a method of removing the aqueous liquid component from the first image, in addition to the present method of pressure contacting the liquid absorbing member, other various conventionally used methods, for example, a method of heating, a method of blowing low humidity air and a method of reducing pressure may be used in combination.

Further, in the liquid absorbing device 105, cleaning units for removing foreign matter attached to the surface of the liquid absorbing member 105*a* having a porous body by the adhesive roller 105*g* is used. In order to prevent the liquid absorbing member 105*a* from being worn by the adhesive force of the adhesive roller 105*g*, a liquid is applied to the liquid absorbing member 105*a* before bringing the adhesive roller 105*g* into contact with the liquid absorbing member 105*a*. As a method of applying the liquid, a method of applying the liquid to the liquid absorbing member 105*a* by the pretreatment device 105*f*, or a method of applying a liquid onto the transfer body 101 and applying the liquid to the liquid absorbing member 105*a* may be used. The pretreatment device 105*f* in FIG. 1 brings the roller into contact with the liquid absorbing member 105*a* and applies the aqueous liquid supplied from the opposite side to the liquid absorbing member 105*a* to the liquid absorbing member 105*a*.

Hereinafter, various conditions and configurations in the liquid absorbing device 105 will be described in detail.

(Pretreatment)

A pretreatment is preferably performed by the pretreatment device 105*f* for applying a treatment liquid to the liquid absorbing member before bringing the liquid absorbing member having the porous body into contact with the image. The treatment liquid preferably contains water and a water-soluble organic solvent. Water is preferably deionized water by ion exchange or the like. Further, the kinds of the water-soluble organic solvent to be used are not particularly limited, and any of known organic solvents such as ethanol and isopropyl alcohol can be used. In the pretreatment of the liquid absorbing member used in the present invention, the application method to the porous body is not particularly limited, and immersion and liquid droplet dripping are preferable.

The position of the pretreatment device 105*f* may also be adjusted by a position control mechanism (not shown). For example, the pretreatment device 105*f* is configured to be reciprocatable in the direction of an arrow C indicated in the drawing so as to be brought into contact with or separated from the outer peripheral surface of the liquid absorbing member 105*a* at the timing when the pretreatment is required. For example, when the ink jet printing apparatus 100 is in an inactive state, the pretreatment device 105*f* can be separated from the outer peripheral surface of the liquid absorbing member 105*a* in advance. The pretreatment device 105*f* can be brought into contact with the outer peripheral surface of the liquid absorbing member 105*a* at the timing of applying the liquid to the liquid absorbing member 105*a* before bringing the adhesive roller 105*g* into contact with the liquid absorbing member 105*a*.

(Pressurizing Condition)

When the pressure (contact pressure P) of the liquid absorbing member pressing against the first image on the transfer body is 0.15 MPa or greater, the liquid component in the first image can be solid-liquid separated in a shorter time period, and the aqueous liquid can be removed from the image, which is preferable. Further, when the pressure is 1.0 MPa or lower, the structural load on the apparatus can be suppressed, which is preferable. In the present invention, the pressure of the liquid absorbing member indicates a nip pressure between the transfer body 101 and the liquid absorbing member 105*a*, and the value of the pressure is calculated by performing surface pressure measurement by using a surface pressure distribution measuring device (I-SCAN (product name), manufactured by NITTA Corporation), and dividing the load in the pressurized region by the area.

(Application Time)

It is preferable that the application time of bringing the liquid absorbing member 105*a* into contact with the image is within 50 ms in order to further suppress the coloring material adhesion in the image to the liquid absorbing member. In addition, when the application time is equal to or longer than 3 ms, the liquid absorbing member 105*a* can be brought into stable contact with the first image, which is preferable. Incidentally, the application time in the present invention is calculated by dividing a pressure sensing width in the moving direction of the transfer body 101 in the above-described surface pressure measurement by the moving speed of the transfer body 101 in the surface pressure measurement. Hereinafter, this application time is referred to as a liquid absorbing nip time.

(Method of Removing Liquid from Liquid Absorbing Member)

The aqueous liquid component absorbed by the liquid absorbing member from the image can be removed from the liquid absorbing member 105*a* by known units. Examples thereof include a method of heating, a method of blowing low humidity air, a method of reducing pressure and a method of squeezing the porous body.

In this way, on the transfer body 101, the aqueous liquid component is absorbed from the first image and a second image with reduced liquid content is formed. The second image is then transferred onto the printing medium 108 at the transfer unit. A device configuration and conditions at the time of transfer will be described.

<Transfer Unit>

In the present embodiment, there are units for transferring the second image on the transfer body 101 to the printing medium 108 conveyed by the printing medium conveyance device 107, by bringing the transfer body 101 into contact with the printing medium 108 by the pressing member 106 for transfer. When removing the aqueous liquid component contained in the first image on the transfer body 101, and then transferring it onto the printing medium 108, it is possible to obtain a printed image in which curling, cockling, and the like, are suppressed. In the present embodiment, the transfer unit is configured to include the transfer member 106 and the transfer body 101.

The pressing member 106 is required to have a certain degree of structural strength from the viewpoint of conveying accuracy and durability of the printing medium 108. For the material of the pressing member 106, metal, ceramic, resin, or the like, is preferably used. Among them, in particular, in order to improve responsiveness of control by reducing inertia during operation in addition to rigidity and dimensional accuracy that can withstand pressurization at the time of transfer, aluminum, iron, stainless steel, acetal resin, epoxy resin, polyimide, polyethylene, polyethylene terephthalate, nylon, polyurethane, silica ceramics alumina ceramics are preferably used. Further, these materials may be used in combination.

The time for performing pressure contact on the second image with respect to the transfer body 101 onto the printing medium 108 is not particularly limited, and, it is preferably 5 ms or longer to 100 ms or shorter from the view point that the transfer is performed well and the durability of the transfer body is not impaired. In the present embodiment, the pressure contact time indicates the time during which the printing medium 108 and the transfer body 101 are in contact with each other, and the value of the time is calculated by performing the surface pressure measurement by using the surface pressure distribution measuring device (I-SCAN, manufactured by NITTA Corporation), and dividing the length in the conveying direction of the pressure region by the conveying speed.

Further, the pressure for performing the pressure contact on the second image with respect to the transfer body 101 onto the printing medium 108 is also not particularly limited as long as the transfer is performed well and the durability of the transfer body is not impaired. Therefore, it is preferable that the pressure is 9.8 $N/cm^2$ (1 $kg/cm^2$) or greater to 294.2$N/cm^2$ (30 $kg/cm^2$) or less. Incidentally, the pressure in the present embodiment indicates the nip pressure between the printing medium 108 and the transfer body 101, and the value of the pressure is calculated by performing the surface pressure measurement by the surface pressure distribution measuring device, and dividing the load in the pressure region by the area.

The temperature for performing the pressure contact on the second image with respect to the transfer body 101 onto the printing medium 108 is also not particularly limited, and it is preferably equal to or greater than a glass transition point or equal to or greater than a softening point of a resin component contained in the ink. For heating, it is preferable to provide heating units for heating a second image on the transfer body 101, the transfer body 101, and the printing medium 108.

The shape of the pressing member 106 is not particularly limited, but for example, a roller shape can be mentioned.

<Cleaning System of Porous Body>

In the apparatus illustrated in FIG. 1, a cleaning system of the porous body is configured to include the adhesive roller 105*g* as a cleaning member and a movement control unit (not shown) for the pretreatment device 105*f* as a liquid applying unit and the adhesive roller 105*a*.

<Printing Medium and Printing Medium Conveyance Device>

In the present embodiment, the printing medium 108 is not particularly limited, and any of known printing media can be used. As the printing medium, a long object wound in a roll shape or a sheet material cut into a predetermined size can be exemplified. Examples of the materials include paper, a plastic film, a wood board, a cardboard and a metal film.

In FIG. 1, the printing medium conveyance device 107 for conveying the printing medium 108 is constituted by a printing medium feeding roller 107*a* and a printing medium winding roller 107*b*, but it is not particularly limited thereto as long as the printing medium can be conveyed.

<Control System>

Figure 3:
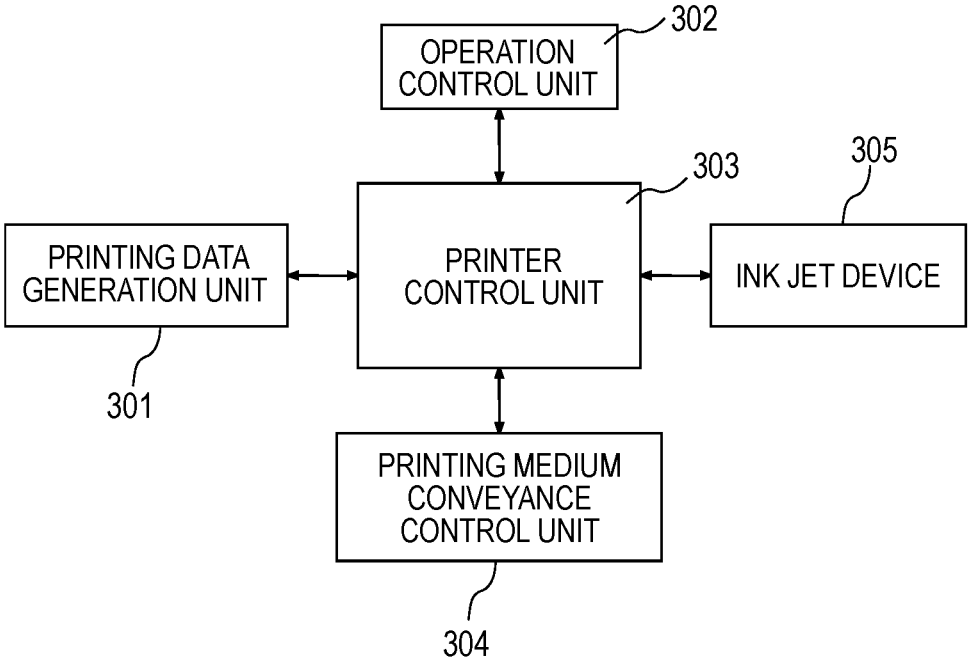
FIG. 3 is a block diagram illustrating a control system of the entire apparatus in the ink jet printing apparatus illustrated in FIGS. 1 and 2.

The direct transfer type ink jet printing apparatus in the present embodiment has a control system for controlling each device. FIG. 3 is a block diagram illustrating a control system of the entire apparatus in the transfer type ink jet printing apparatus illustrated in FIG. 1.

In FIG. 3, a reference numeral 301 represents a printing data generation unit, such as an external print server, a reference numeral 302 represents an operation control unit, such as an operation panel, a reference numeral 303 represents a printer control unit for executing a printing process, a reference numeral 304 represents a printing medium conveyance control unit for conveying the printing medium, and a reference numeral 305 represents an ink jet device for printing.

Figure 4:
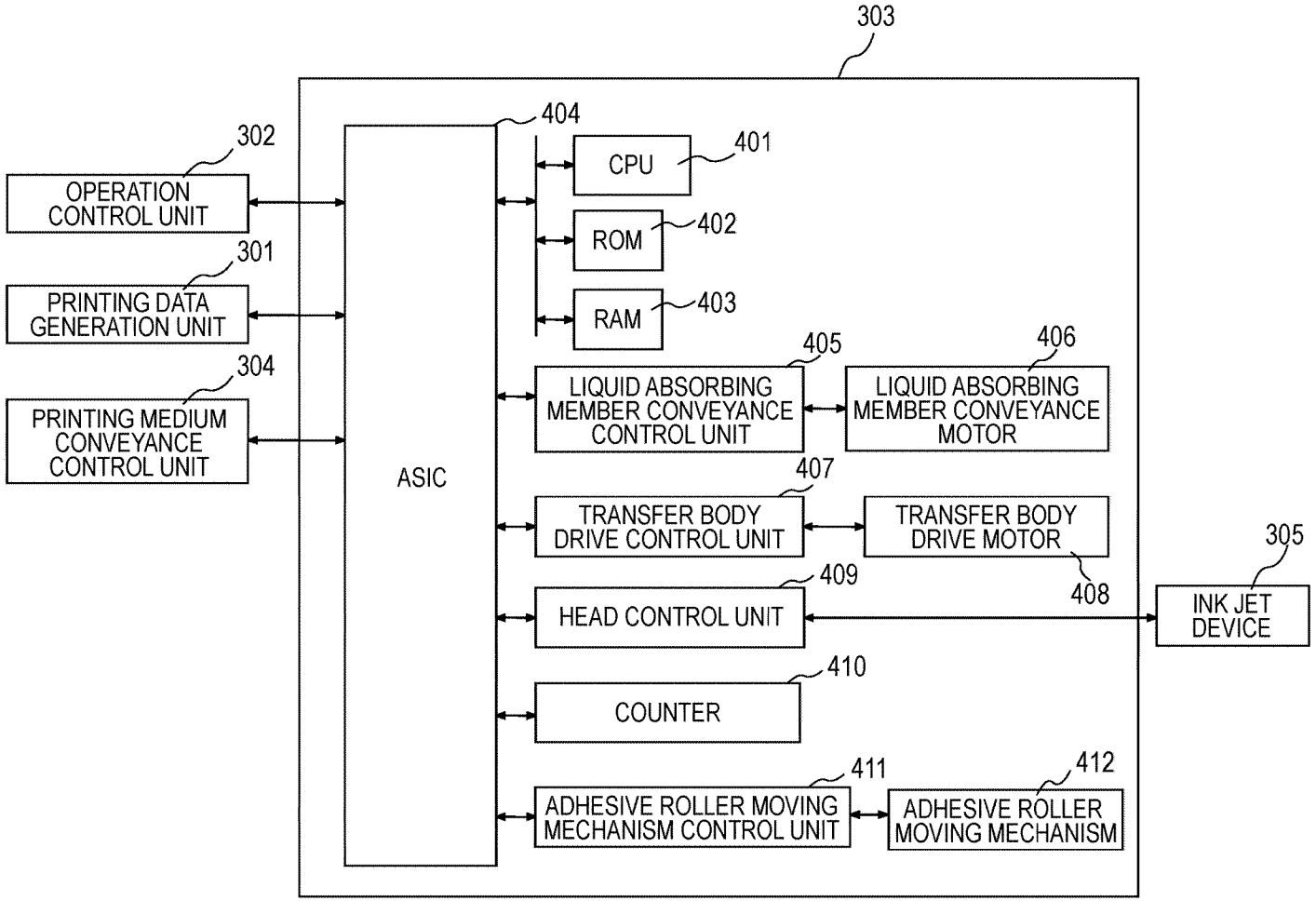
FIG. 4 is a block diagram of a printer control unit in the transfer type ink jet printing apparatus illustrated in FIG. 1.

FIG. 4 is a block diagram of a printer control unit in the transfer type ink jet printing apparatus illustrated in FIG. 1.

A reference numeral 401 represents a CPU for controlling the entire printer, a reference numeral 402 represents a ROM for storing a control program of the CPU, and a reference numeral 403 represents a RAM for executing the program.

A program for determining the amount of liquid to be applied to the liquid absorbing member 105*a* is stored in the ROM 402.

A reference numeral 404 represents an application specific integrated circuit (ASIC) including a network controller, a serial IF controller, a controller for generating head data, a motor controller, and the like. A reference numeral 405 represents a liquid absorbing member conveyance control unit for driving a liquid absorbing member conveyance motor 406, and the liquid absorbing member conveyance control unit 405 is controlled by a command from the ASIC 404 via the serial IF. A reference numeral 407 represents a driving control unit for a transfer body that drives a driving motor 408 for transfer body, and similarly, the transfer body driving control unit 407 is controlled by a command from the ASIC 404 via the serial IF. A reference numeral 409 represents a head control unit which performs final discharge data generation, drive voltage generation, and the like, of the ink jet device 305.

Figure 6:
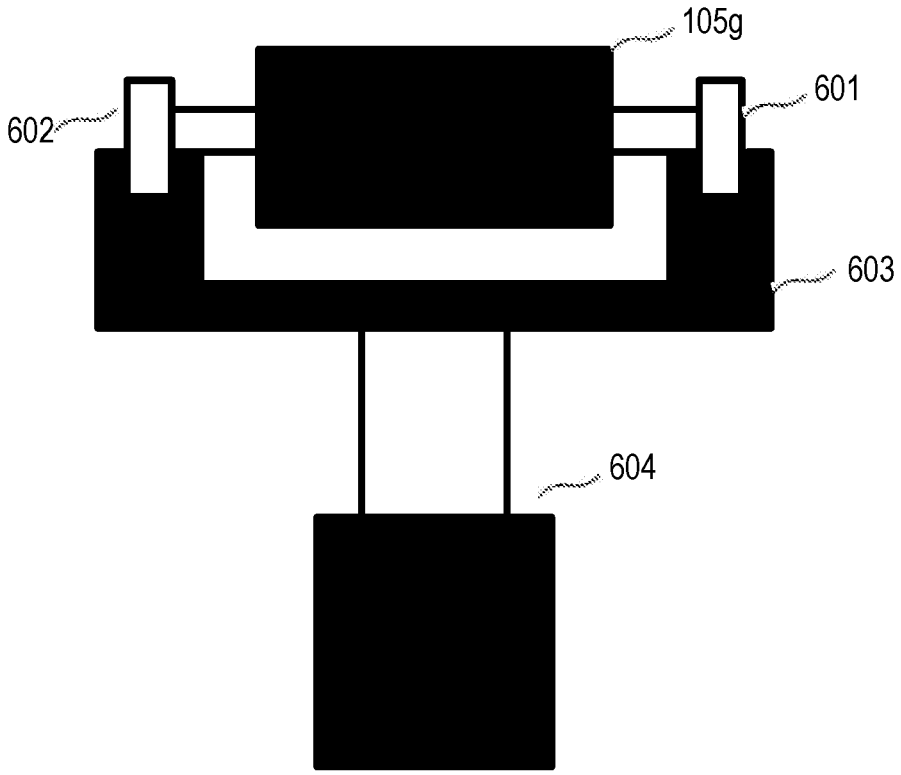
FIG. 6 is a schematic diagram illustrating one example of a configuration of an adhesive roller moving mechanism.

A reference numeral 410 is a counter. A reference numeral 411 is an adhesive roller moving mechanism control unit for controlling an adhesive roller moving mechanism 412. Details of the adhesive roller moving mechanism 412 will be described with reference to FIG. 6. FIG. 6 illustrates an example in which the adhesive roller uses an air cylinder. Ball bearings 601 and 602 are attached to both ends of the shaft of the adhesive roller 105*g* and are attached to a support 603 supporting the adhesive roller 105*g*. By moving the support 603 up and down by the air cylinder 604, the adhesive roller 105*g* can abut on the liquid absorbing member 105*a* and be separated therefrom.

In a case of performing the position control illustrated in FIG. 1 of the pressing member and the pretreatment device, a position control portion of the pressing member to be subjected to command control and a position control portion of the pretreatment device are provided from the ASIC 404 via a serial IF.

(Direct Drawing Type Ink Jet Printing Apparatus)

As another embodiment of the present invention, a direct drawing type ink jet printing apparatus can be used. In the direct drawing type ink jet printing apparatus, the ink receiving medium is a printing medium on which an image is to be formed.

Figure 2:
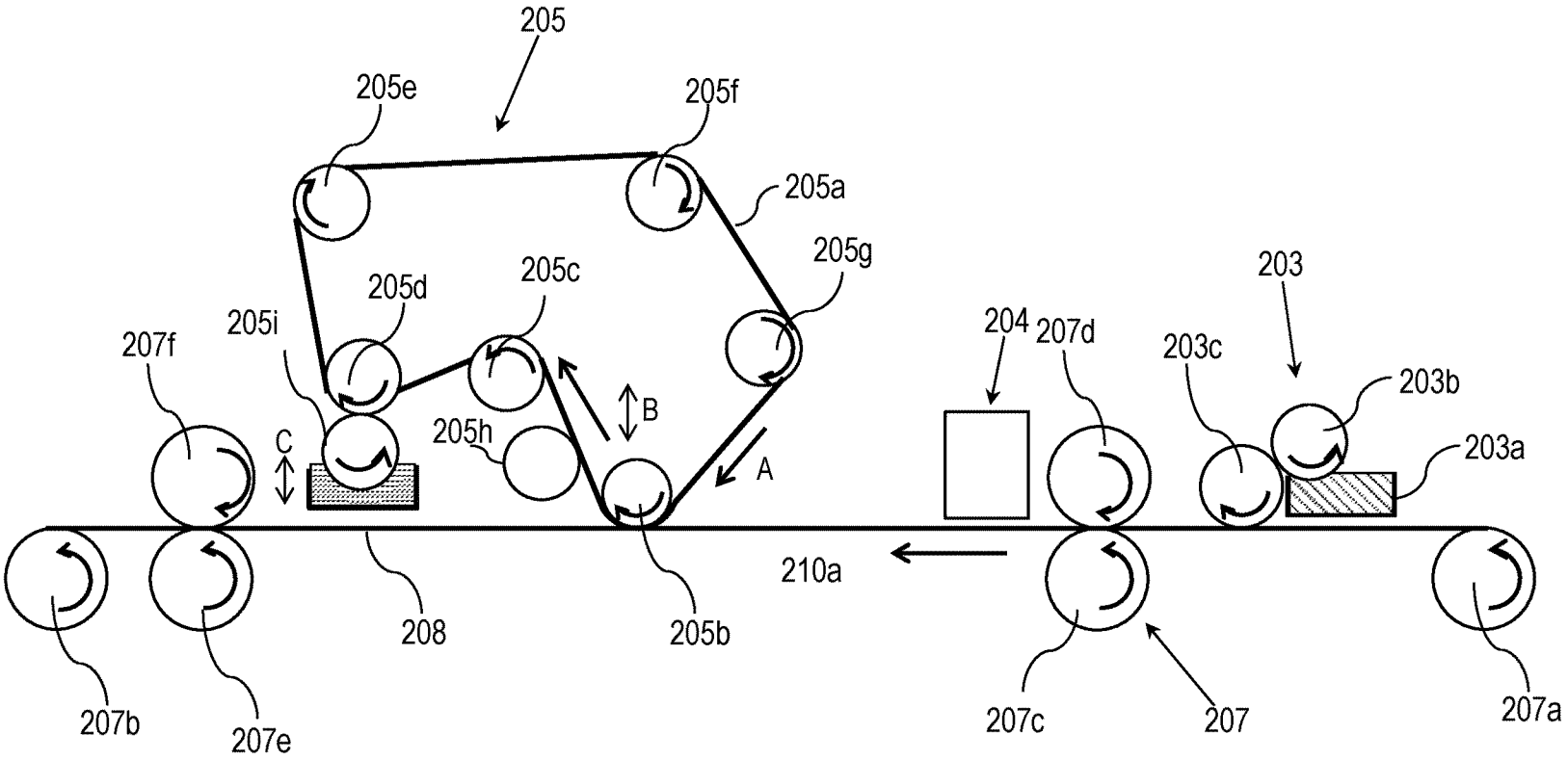
FIG. 2 is a schematic diagram illustrating one example of a configuration of a direct drawing type ink jet printing apparatus according to the present invention.

FIG. 2 is a schematic diagram illustrating one example of a schematic configuration of a direct drawing type ink jet printing apparatus 200 of the present embodiment. Compared to the transfer type ink jet printing apparatus described above, the direct drawing type ink jet printing apparatus has units similar to those of the transfer type ink jet printing apparatus, except that it does not have the transfer body 101, the support member 102, or the transfer body cleaning member 109, and forms an image on a printing medium 208.

Therefore, by units of a reaction liquid applying device 203 for applying the reaction liquid to the printing medium 208, an ink applying device 204 for applying ink to the printing medium 208, and a liquid absorbing member 205*a* coming into contact with a first image on the printing medium 208, a liquid absorbing device 205 that absorbs the aqueous liquid component contained in the first image has the same configuration as that of the transfer type ink jet printing apparatus, and thus, an explanation thereof will not be provided.

Note that, in the direct drawing type ink jet printing apparatus of the present embodiment, the liquid absorbing device 205 includes the liquid absorbing member 205*a*, and a pressing member 205*b* which presses the liquid absorbing member 205*a* against the first image on the printing medium 208. The shapes of the liquid absorbing member 205*a* and the pressing member 205*b* are not particularly limited, and it is possible to use the same shapes as the liquid absorbing member 205*a* and the pressing member 205*b* that can be used in the transfer type ink jet printing apparatus. In addition, the liquid absorbing device 205 may include an extending member for extending the liquid absorbing member 205*a*. In FIG. 2, reference numerals 205*c*, 205*d*, 205*e*, 205*f*, and 205*g* represent an extending roller as the extending member. The number of the extending rollers is not limited to five as illustrated in FIG. 2, and a necessary number of the extending rollers may be arranged according to the apparatus design. A printing medium support member (not shown) for supporting the printing medium from below may be provided at a position facing a printing unit for applying ink to the printing medium 208 by the ink applying device 204, and a liquid absorbing device for pressing the liquid absorbing member 205*a* against the first image on the printing medium to remove the aqueous liquid component.

A reference numeral 205*h* is an adhesive roller for cleaning the liquid absorbing member 205*a*, and a reference numeral 205*i* is a pretreatment device, as one of pretreatment units for applying a treatment liquid to the liquid absorbing member.

The position of the pressing member 205*b* and a pretreatment device 205*i* may be adjusted by the position control mechanism (not shown) in the directions of the arrows B and C respectively, similar to the apparatus illustrated in FIG. 1.

<Printing Medium Conveyance Device>

In the direct drawing type ink jet printing apparatus of the present embodiment, a printing medium conveyance device 207 is not particularly limited, and a conveyance device in a known direct drawing type ink jet printing apparatus can be used. Examples thereof include, as illustrated in FIG. 2, a printing medium conveyance device including a printing medium feeding roller 207*a*, a printing medium winding roller 207*b*, and printing medium conveyance rollers 207*c*, 207*d*, 207*e* and 207*f*

<Control System>

The direct drawing type ink jet printing apparatus in the present embodiment has a control system for controlling each device. The block diagram illustrating a control system of the entire apparatus in the direct drawing type ink jet printing apparatus illustrated in FIG. 2 is as illustrated in FIG. 3 similar to the transfer type ink jet printing apparatus illustrated in FIG. 1.

Figure 5:
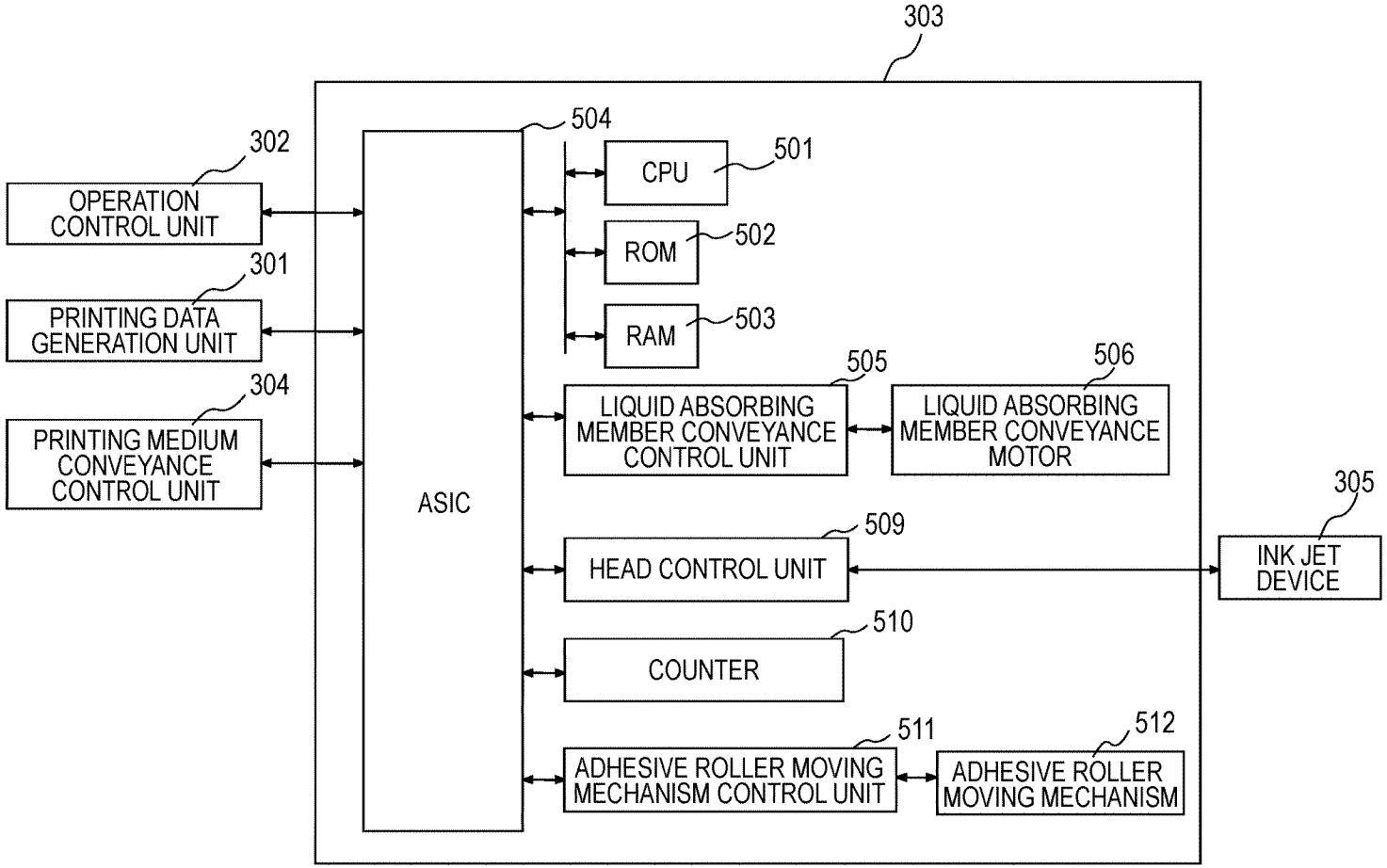
FIG. 5 is a block diagram of a printer control unit in a direct drawing type ink jet printing apparatus illustrated in FIG. 2.

FIG. 5 is a block diagram of a printer control unit in the direct drawing type ink jet printing apparatus illustrated in FIG. 2. Except for not including the driving control unit 407 for transfer body and the driving motor 408 for transfer body, FIG. 5 is the same block diagram as the block diagram of the printer control unit in the transfer type ink jet printing apparatus in FIG. 4.

In other words, reference numeral 501 represents a CPU for controlling the entire printer, a reference numeral 502 represents a ROM for storing a control program of the CPU and a reference numeral 503 represents a RAM for executing the program. A reference numeral 504 represents an ASIC including a network controller, a serial IF controller, a controller for generating head data, a motor controller and the like. A reference numeral 505 represents a liquid absorbing member conveyance control unit for driving a conveyance motor for liquid absorbing member 506, and the liquid absorbing member conveyance control unit 505 is controlled by a command from the ASIC 504 via the serial IF. A reference numeral 509 represents a head control unit which performs final discharge data generation, drive voltage generation and the like of the ink jet device 305.

A reference numeral 510 is a counter. A reference numeral 511 is an adhesive roller moving mechanism control unit for controlling the adhesive roller moving mechanism 512. In addition, in a case of performing the position control illustrated in FIG. 1 of the pressing member and the pretreatment device, a position control portion of the pressing member to be subjected to command control and a position control portion of the pretreatment device are provided from the ASIC 404 via the serial IF.

Information on the kind of the paper can be acquired by comparing data such as surface roughness and basis weight (weight) with library data previously held or information input from a user interface.

EXAMPLES

Hereinafter, the present invention will be more specifically described with reference to examples and comparative examples. The present invention is not limited by the following examples without departing from the gist thereof.

Example 1

When image printing is performed using the apparatus illustrated in FIG. 1, the liquid absorbing member 105*a* is conveyed in the direction of arrow Ain FIG. 1 by the liquid absorbing member conveyance control unit 405 in FIG. 4. Since the liquid absorbing member 105*a* has a belt shape, it passes through the transfer body 101, the adhesive roller 105*g*, and the pretreatment device 105*f*, in this order, to make one turn. In this conveying step, the liquid absorbing member 105*a* absorbs the aqueous liquid component from the image formed with the highly viscous ink on the transfer body 101, and becomes in a state of holding the liquid. Further, when performing the pretreatment before starting the image forming step, the liquid is absorbed from the pretreatment device 105*f*, and becomes in a state of holding the liquid. By passing the transfer body 101 or the pretreatment device 105*f* many times, it is possible to increase the liquid holding amount of the liquid absorbing member 105*a*.

As the adhesive roller 105*g*, an adhesive roller having the following specifications was used.

Specification of adhesive roller:

Rubber material·Hardness: Butyl rubber, 30° (Asker-C hardness)

Nip pressure/nip width: 1.0 kgf/cm$^2$, 6 mm

Tacking Force at the time of release between adhesive rubber-porous Body (Dry State): 0.4 kgf/cm$^2$ When the image printing is completed, the liquid absorbing member conveyance control unit 405 stops the liquid absorbing member 105*a* and enters a standby state. In the standby state, the liquid is not absorbed by the liquid absorbing member 105*a*, and thus, the moisture evaporates with the elapse of time according to the ambient temperature and humidity, and the liquid holding amount is decreased. At this time, by controlling the standby time, it is possible to calculate the liquid holding amount of the liquid absorbing member 105*a*.

The adhesive force of the adhesive roller 105*g* varies depending on the liquid holding amount of the liquid absorbing member 105*a* to be cleaned. When the liquid holding amount is small, the adhesive force is enhanced, and, when the liquid holding amount is large, the adhesive force is weakened. In the present invention, in order to remove foreign matter attached to the liquid absorbing member 105*a* during the image printing, it is preferable to use an adhesive roller having the adhesive force capable of removing foreign matter in a state in which the liquid holding amount of the liquid absorbing member 105*a* is large. Therefore, in a state in which the liquid holding amount of the liquid absorbing member 105*a* is small, a very strong adhesive force is exerted and the liquid absorbing member 105*a* may be worn out in some cases.

In a case where the liquid is held in an amount larger than the porosity of the liquid absorbing member 105*a*, no adhesive force acts on the foreign matter attached to the liquid absorbing member 105*a* due to overflow of the liquid to the surface, and thus, the foreign matter cannot be removed in some cases. In such a case, it is possible to add a step of evaporating the liquid component from the porous body of the liquid absorbing member 105*a* by moving the liquid absorbing member 105*a* to a position separated from the transfer body 101, and performing idle rotation a necessary number of times in a state where the liquid absorbing operation is not performed. In order to remove attached foreign matter without wearing the liquid absorbing member 105*a*, a state of appropriate liquid holding amount is necessary.

Figure 7A:
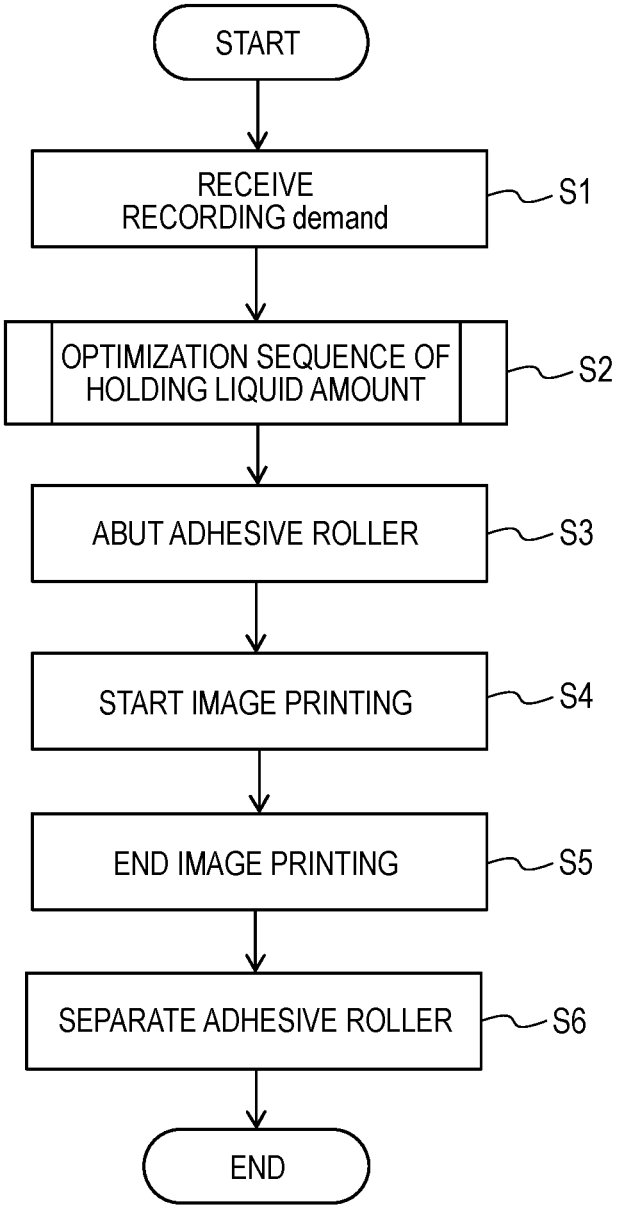
FIG. 7A is a flowchart illustrating a control flow of Example 1.
Figure 7B:
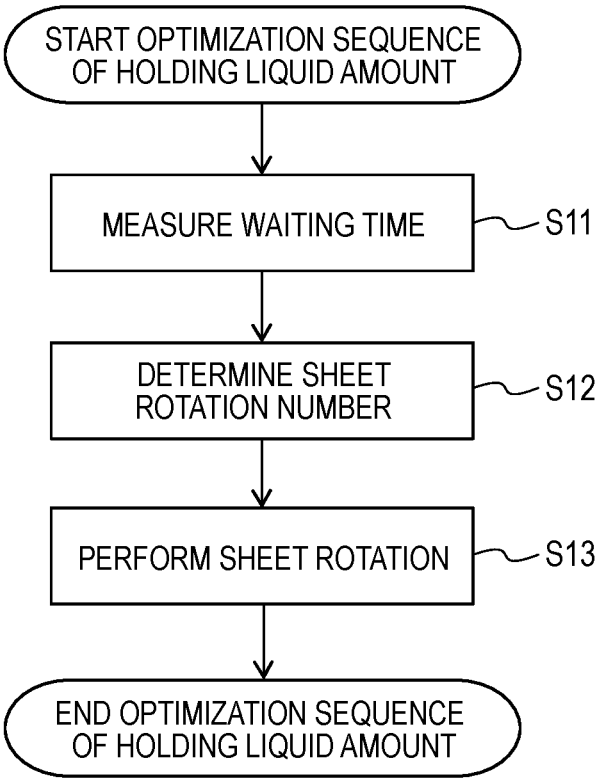
FIG. 7B is a flowchart illustrating a control flow of Example 1.

FIG. 7A illustrates a flow at the time of image printing. FIG. 7B illustrates a flow of an optimization sequence of the holding liquid amount of the liquid absorbing member 105*a*.

In the flow of FIG. 7A, when a printer control unit 303 receives a printing command from a printing data generating unit 301 (step S1), the optimization sequence of the holding liquid amount is performed (step S2). Thereafter, the adhesive roller 105*g* is moved by the adhesive roller moving mechanism 412 as a cleaning member moving control unit and abuts the liquid absorbing member 105*a* (step S3). After the image printing is started (step S4) and the image printing is finished (step S5), the adhesive roller 105*g* is separated from the liquid absorbing member 105*a* by the adhesive roller moving mechanism 412 (step S6).

When the holding solution amount optimization sequence in FIG. 7B is started, a program acquires information on the standby time from the counter 302 constituting the time measuring unit (step S11). The number of rotations of the liquid absorbing member 105*a* is determined by using the acquired information on the standby time and the table in Table 1 (step S12). The liquid absorbing member conveyance control unit 406 conveys the liquid absorbing member 105*a* based on the determined number of rotations (step S13), and the optimization sequence of the holding liquid amount is finished.

TABLE 1

| Elapsed time (h) | Number of rotations (times) |
|---|---|
| 0-24 | 0 |
| 24-48 | 10 |
| 48-72 | 20 |
| 72- | 30 |

The application of the liquid to the liquid absorbing member 105*a* may be performed by the transfer body 101 at the time of image printing or by the pretreatment device 105*f* before the start of the image forming step.

In a case of applying the liquid to the liquid absorbing member 105*a* with the transfer body 101 at the time of image printing, image printing is started without abutting the adhesive roller. When the image printing is started, the liquid absorbing member 105*a* applies the liquid by absorbing the liquid from the printed image. After the start of image printing, abutment of the adhesive roller is performed when the liquid absorbing member 105*a* has rotated a plurality of times.

In the present example, the timing of separating the adhesive roller 105*g* from the liquid absorbing member 105*a* is exemplified as the timing after completion of the image printing. The adhesive roller 105*g* may also be separated, however, even if the apparatus emergency stops due to a trouble of the apparatus (emergency stop). Further, it may use a configuration in which a standby power supply is built in the apparatus and the adhesive roller 105*g* is separated when a power failure occurs.

Example 2

Figure 8:
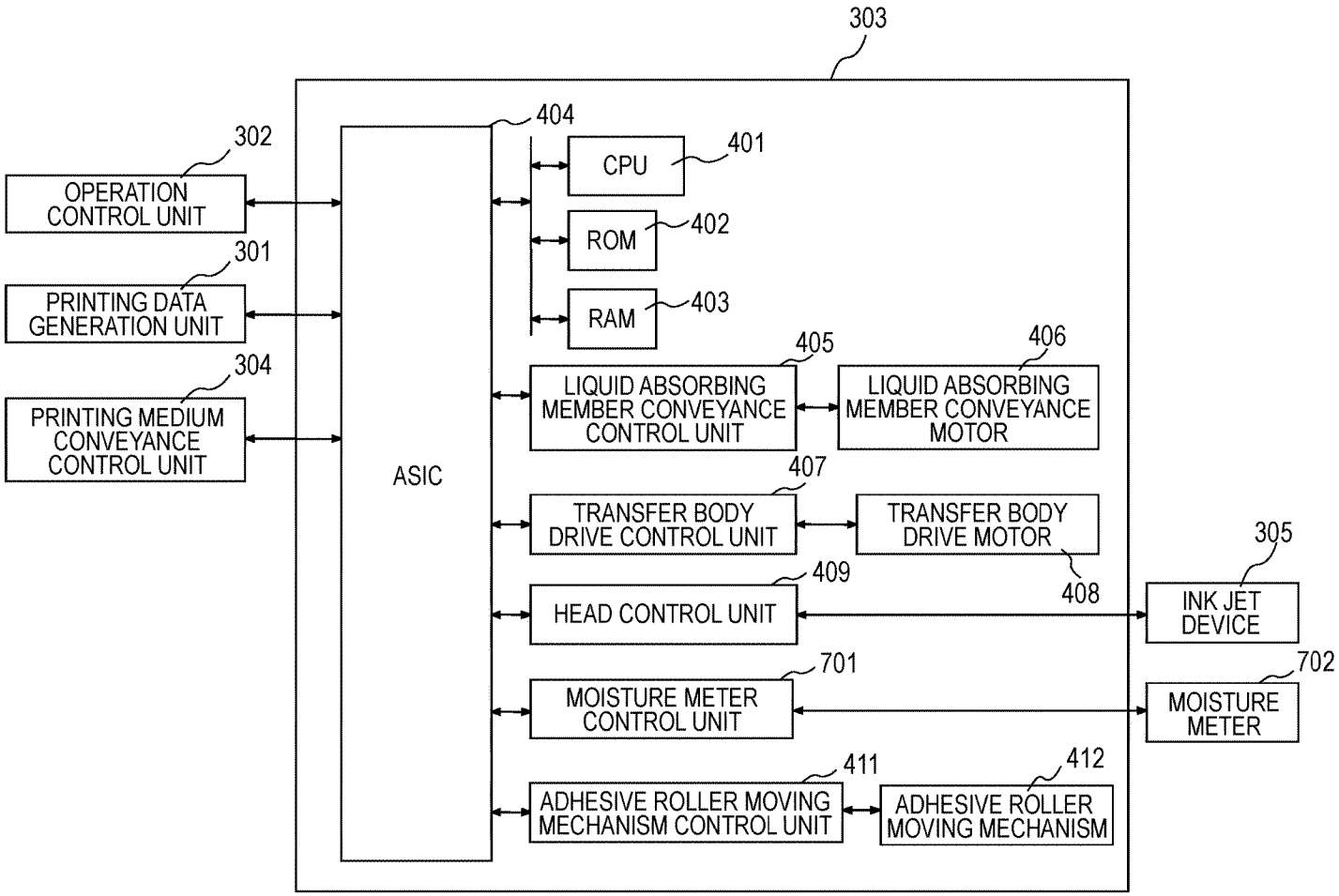
FIG. 8 is a block diagram illustrating a control system of Example 2.
Figure 9:
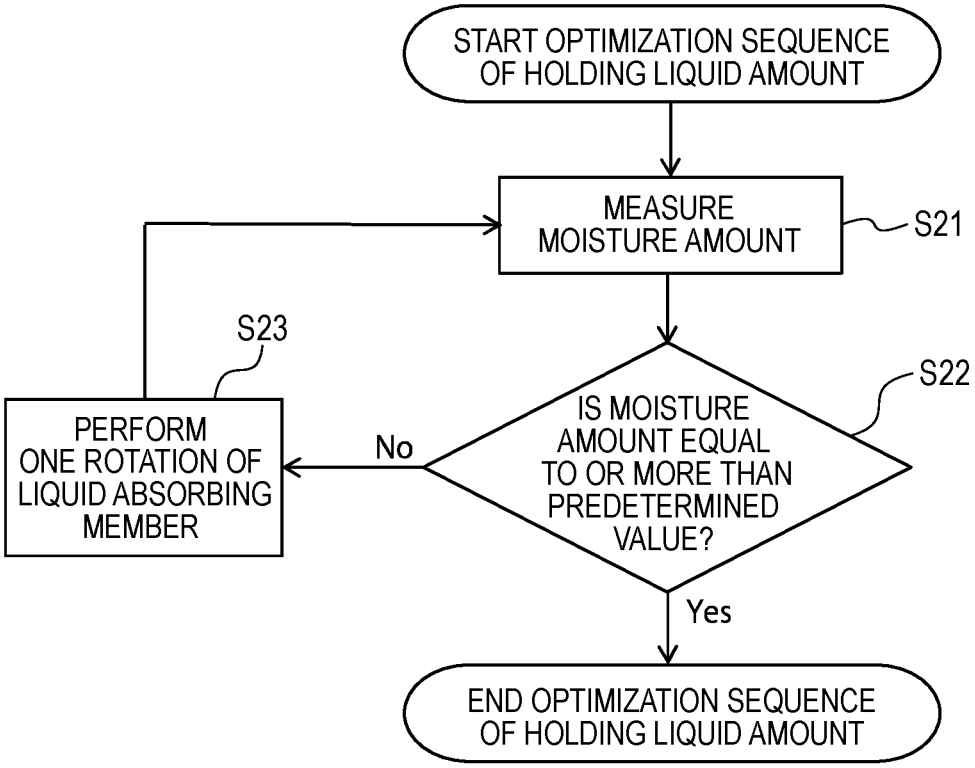
FIG. 9 is a flowchart illustrating a control flow of Example 2.

In Example 2, the liquid holding amount of the liquid absorbing member 105*a* is measured by the moisture meter 702. The rest of the configuration is the same as that Example 1. The moisture meter 702 is preferably the type that performs measurement in a non-contact manner using infrared rays. In addition, it is preferable that the moisture meter is provided between the transfer body 101 and the adhesive roller 105*g*. FIG. 8 is a block diagram illustrating a control system of each control unit used in the present example. Hereinafter, only the optimization sequence of the holding liquid amount which is different from Example 1 will be described. FIG. 9 illustrates a flow of an optimization sequence of the holding liquid amount in Example 2. When the optimization sequence of the holding liquid amount of FIG. 9 is started, the moisture amount of the liquid absorbing member 105*a* is measured by the moisture meter 702 (step S21). In the program, from the measurement result of the moisture meter 703, it is determined whether or not the moisture amount of the liquid absorbing member 105*a* exceeds a predetermined amount (step S22). In a case where it exceeds the predetermined amount, the optimization sequence of the holding liquid amount is finished. In a case where it does not exceed the predetermined amount, the liquid absorbing member conveyance control unit 405 rotates the liquid absorbing member 101*a* by one turn (step S23). After rotation by one turn, the moisture amount measurement is performed again (step S21), and the steps from steps S21 to S23 are repeated until the moisture amount of the liquid absorbing member 105*a*exceeds the predetermined amount.

In the present example, the moisture amount is measured for each rotation of the liquid absorbing member 105*a*. The measurement and determination of the moisture amount may, however, be performed while continuously operating the liquid absorbing member 105*a*. Alternatively, a method may be used in which the number of rotations is determined based on the measurement result of the moisture amount, and the measurement and determination are performed after rotating by the determined number of rotations.

In the case of using a configuration capable of measuring the amount of liquid holding amount while conveying the liquid absorbing member 105*a* as in the present example, when it is detected that the liquid holding amount is less than the predetermined amount while the adhesive roller 105*g* is brought in contact with the liquid absorbing member 105*a* during the image printing, the operation of separating the adhesive roller 105*g* may be performed.

Example 3

In Example 3, the control in a case where units for calculating and measuring the liquid holding amount of the liquid absorbing member 105*a* in Example 1 and Example 2 are not provided will be described. The rest of the configuration is the same as those in Examples 1 and 2.

Figure 10:
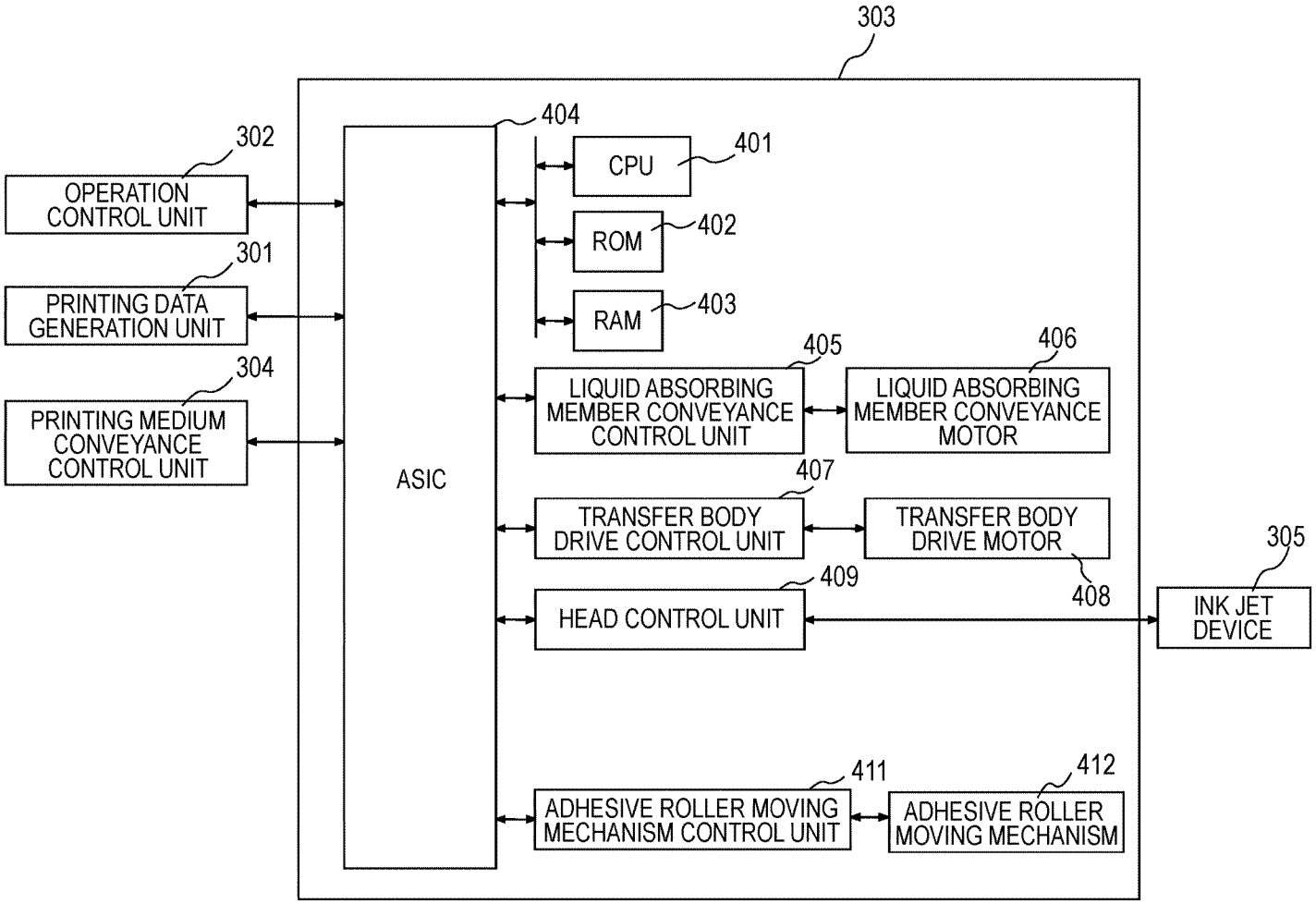
FIG. 10 is a block diagram illustrating a control system of Example 3.
Figure 11:
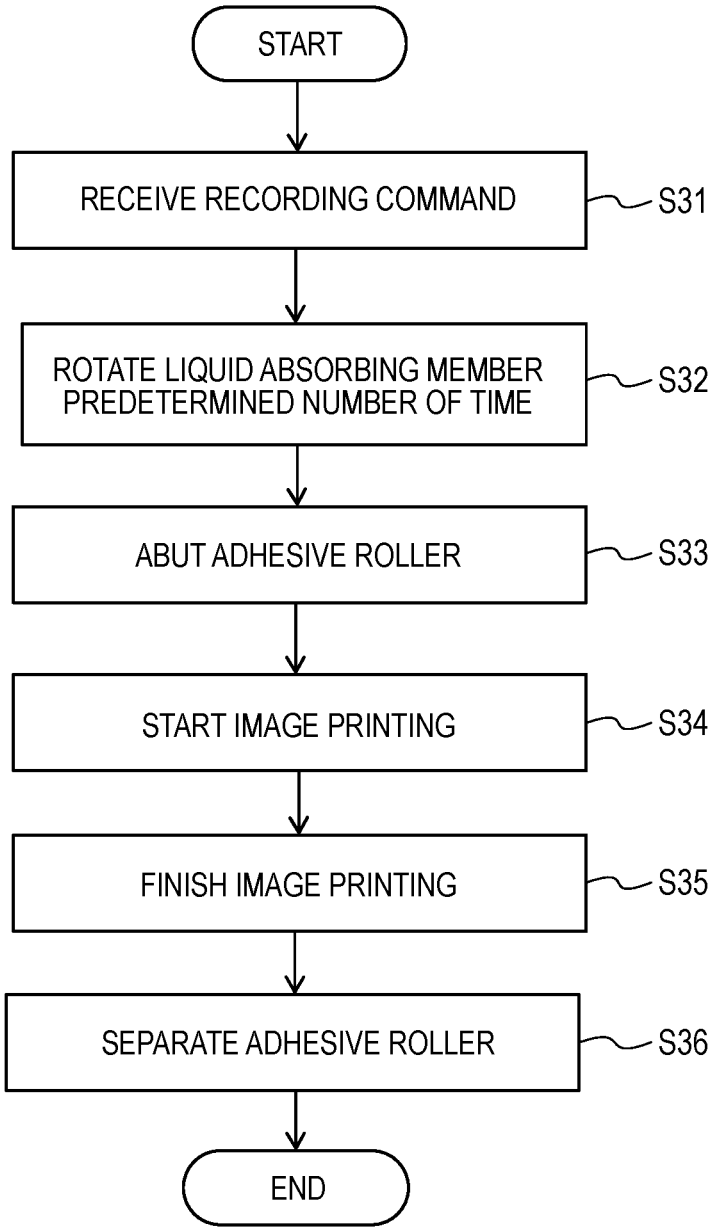
FIG. 11 is a flowchart illustrating a control flow of Example 3.

FIG. 10 illustrates a block diagram of each control unit of Example 3. FIG. 11 illustrates a flow at the time of image printing of Example 3. In the flow of FIG. 11, when the printer control unit 303 receives a printing command from the printing data generating unit 301 (step S31), the liquid absorbing member conveyance control unit 406 conveys the liquid absorbing member 105*a* for a predetermined number of times (step S32). In this case, the adhesive roller 105*g* and the liquid absorbing member 105*a* are separated from each other. Thereafter, the adhesive roller 105*g* is moved by the adhesive roller moving mechanism 412 and abuts the liquid absorbing member 105*a* (step S33). After the image printing is started in a state where the adhesive roller 105*g* is in contact with the liquid absorbing member 105*a* (step S34), and the image printing is finished (step S35), the adhesive roller 105*g* is separated from the liquid absorbing member 105*a* by the adhesive roller moving mechanism 412 (step S36). The adhesive roller 105*g* and the liquid absorbing member 105*a* may be separated from each other until the next printing command is received. Example 3 describes an example at the time of activating the apparatus when the image printing is performed. The image printing and the flow of FIG. 11 may, however, be used in combination by separating the adhesive roller 105*g* during the image printing and then performing steps S32 and S33 in this order in the flow of FIG. 11.

According to the configuration of the present invention, it is possible to provide an ink jet printing apparatus having a porous body cleaning system capable of reducing damage to the porous body while maintaining removal performance of attached matters from a porous body included in a liquid absorbing member.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An ink jet printing apparatus comprising:

an image forming unit that includes an ink jet printing unit for applying ink containing an aqueous liquid medium and a coloring material on an ink receiving medium to form a first image containing an aqueous liquid component and the coloring material;

a liquid absorbing unit that is provided with a liquid absorbing member including a porous body, which includes a liquid absorbing surface configured to be brought into contact with the first image, and which absorbs at least a portion of the aqueous liquid component from the first image via the liquid absorbing surface;

a cleaning member that is disposed so as to be in contact with a liquid absorbing surface of the porous body and that has an adhesive force for removing attached matters from the liquid absorbing surface;

acquisition units for acquiring information on a moisture amount in the porous body;

a liquid application amount determining unit that determines a liquid application amount to be applied to the porous body in order to bring the liquid absorbing surface of the porous body, which is to be brought into contact with the cleaning member, into a wet state for removing attached matters on the liquid absorbing surface by the adhesive force of the cleaning member based on the acquired information; and a liquid applying unit that applies an aqueous liquid to the porous body in accordance with the application amount determined by the liquid application amount determination unit.

2. The ink jet printing apparatus according to claim 1, further comprising a time measuring unit that measures elapsed time from an end of a previous image forming step to a start of a subsequent image forming step, wherein the liquid application amount determining unit determines the application amount in accordance with the elapsed time measured by the time measurement unit.

3. The ink jet printing apparatus according to claim 2, wherein the liquid application amount determining unit determines the liquid application amount of the porous body in accordance with a temperature and humidity around the porous body.

4. The ink jet printing apparatus according to claim 1, further comprising a moisture meter that measures a moisture amount of the porous body, wherein the liquid application amount determining unit determines the liquid application amount in accordance with the moisture amount measured by the moisture meter.

5. The ink jet printing apparatus according to claim 1, further comprising a cleaning member moving control unit that causes the cleaning member to abut or to be separated from the liquid absorbing surface of the porous body, wherein the cleaning member is movable to a position separated from the porous body by the cleaning member moving control unit after completion of an image forming step.

6. The ink jet printing apparatus according to claim 1, wherein the cleaning member moving control unit causes the cleaning member to be moved to a position separated from the porous body when the ink jet printing apparatus is stopped.

7. The ink jet printing apparatus according to claim 1, wherein the ink receiving medium is a transfer body for temporarily holding the first image and a second image, which is an ink image that remains on the ink receiving medium after the liquid absorbing unit absorbs at least the portion of the aqueous liquid component from the first image, and wherein the apparatus further comprises a transfer unit that transfers the second image from the ink receiving medium to a printing medium for forming a final image.

8. The ink jet printing apparatus according to claim 1, wherein the ink receiving medium is a printing medium for forming a final image, and wherein the first image and a second image, which is an ink image that remains on the ink receiving medium after the liquid absorbing unit absorbs at least the portion of the aqueous liquid component from the first image, are formed on the printing medium.

9. The ink jet printing apparatus according to claim 1, wherein the liquid absorbing unit absorbs the portion of the aqueous liquid component from the first image to concentrate the ink constituting the first image.

10. An ink jet printing apparatus comprising:

an image forming unit that includes an ink jet printing unit for applying ink containing an aqueous liquid medium and a coloring material on an ink receiving medium to form a first image containing an aqueous liquid component and the coloring material;

a liquid absorbing unit that is provided with a liquid absorbing member including a porous body which includes a liquid absorbing surface configured to be brought into contact with the first image, and which absorbs at least a portion of the aqueous liquid component from the first image via the liquid absorbing surface;

a cleaning member that is disposed so as to be in contact with a liquid absorbing surface of the porous body and that has an adhesive force for removing attached matters from the liquid absorbing surface;

a moving control unit that brings the cleaning member and the porous body into contact with each other when the image forming unit forms the first image on the ink receiving medium and causes the cleaning member and the porous body to be separated from each other after the image forming unit forms the first image; and a liquid applying unit that applies an aqueous liquid to the porous body in order to bring the porous body into a wet state for removing attached matters on the liquid absorbing surface of the porous body by the adhesive force of the cleaning member, wherein the liquid applying unit applies the aqueous liquid to the porous body before the moving control unit brings the cleaning member into contact with the porous body.

11. The ink jet printing apparatus according to claim 10, further comprising receiving units for receiving a printing command from an external device, wherein the liquid applying unit applies the aqueous liquid to the porous body when the receiving units receive the printing command in a state in which the cleaning member is separated from the porous body, and, thereafter, the image forming unit starts to form the first image after the moving control unit brings the cleaning member into contact with the porous body.

12. An ink jet printing control method comprising:

an image forming step of forming a first image containing an aqueous liquid component and the coloring material using an image forming unit that includes an ink jet printing unit for applying ink containing the aqueous liquid component and the coloring material on an ink receiving medium;

a liquid absorbing step of absorbing at least a portion of the aqueous liquid component from the first image via a liquid absorbing surface, using a liquid absorbing unit that is provided with a liquid absorbing member including a porous body, which includes the liquid absorbing surface that is configured to be brought into contact with the first image;

a cleaning step of cleaning the liquid absorbing member using a cleaning member that is disposed so as to be in contact with a liquid absorbing surface of the porous body and that has an adhesive force for removing attached matters from the liquid absorbing surface;

a contacting step of bringing the cleaning member and the porous body into contact with each other when the image forming unit forms the first image on the ink receiving medium;

a separating causing step of causing the cleaning member and the porous body to be separated from each other after the image forming unit forms the first image; and an applying step of applying an aqueous liquid to the porous body in order to bring the porous body into a wet state for removing attached matters on the liquid absorbing surface of the porous body by the adhesive force of the cleaning member, wherein the applying step is executed before the contacting step.

13. The ink jet printing method according to claim 12, wherein, in the image forming step, a transfer body for temporarily holding the first image and a second image, which is an ink image that remains on the ink receiving medium after the liquid absorbing unit absorbs at least the portion of the aqueous liquid component from the first image, is used as the ink receiving medium, and the method further comprises a transferring step of transfer the second image to a printing medium for forming a final image.

14. The ink jet printing method according to claim 12, wherein, in the image forming step, a printing medium, on which a final image is to be formed, is used as the ink receiving medium.

15. The ink jet printing method according to claim 12, wherein, in the liquid absorbing step, the portion of the aqueous liquid component is absorbed from the first image to concentrate the ink constituting the first image.

* * * * *